US010210686B2

(12) United States Patent
Gengler et al.

(10) Patent No.: US 10,210,686 B2
(45) Date of Patent: Feb. 19, 2019

(54) ELECTRONIC PADLOCKS AND RELATED METHODS

(71) Applicant: NOKE, INC., Lehi, UT (US)

(72) Inventors: David P. Gengler, Draper, UT (US); Arthur Healey, Centerville, UT (US); Cameron Gibbs, Draper, UT (US)

(73) Assignee: Noke, Inc., Lehi, UT (US)

( * ) Notice: Subject to any disclaimer, the term of this patent is extended or adjusted under 35 U.S.C. 154(b) by 0 days.

(21) Appl. No.: 15/669,811

(22) Filed: Aug. 4, 2017

(65) Prior Publication Data

US 2018/0018841 A1 Jan. 18, 2018

Related U.S. Application Data

(63) Continuation of application No. 15/009,640, filed on Jan. 28, 2016, now Pat. No. 9,728,022.

(Continued)

(51) Int. Cl.

| | |
|---|---|
| ***G07C 9/00*** | (2006.01) |
| ***E05B 67/22*** | (2006.01) |
| *E05B 47/00* | (2006.01) |

(52) U.S. Cl.

CPC ..... *G07C 9/00174* (2013.01); *E05B 67/22* (2013.01); *G07C 9/00309* (2013.01);

(Continued)

(58) Field of Classification Search

CPC ..... G07C 9/00174; G07C 9/00309; G07C 2209/08; G07C 2009/00865;

(Continued)

(56) References Cited

U.S. PATENT DOCUMENTS

| | | | |
|---|---|---|---|
| 1,882,794 | A | 10/1932 | Full |
| 2,049,416 | A | 8/1936 | Aldeen |

(Continued)

FOREIGN PATENT DOCUMENTS

| | | |
|---|---|---|
| CN | 204002132 | 12/2014 |
| EP | 2607582 | 6/2013 |

(Continued)

OTHER PUBLICATIONS

ActiveKEY, "ActiveKEY User Manual", http://www.supraekey.com/Documents/ActiveKEY_user_manual.pdf, Feb. 2013.

(Continued)

*Primary Examiner* — Thomas D Alunkal

(74) *Attorney, Agent, or Firm* — Phillips, Ryther & Winchester; Justin K. Flanagan

(57) ABSTRACT

Disclosed are electronic padlocks and related methods. An electronic padlock includes a lock body, a shank, and a locking mechanism operably coupled to electronic circuitry configured to detect physical interactions of a user with the shank and control the locking mechanism. A method of operating the electronic padlock includes detecting physical interactions of a user with a shank of an electronic padlock, comparing the detected physical interactions with a stored predetermined series of physical interactions, and transitioning from a locked state to an unlocked state responsive to determining that the detected physical interactions match the predetermined series of physical interactions. A method of transforming a mobile device into a device configured to interface with an electronic padlock includes distributing computer-readable instructions configured to instruct one or more processors of the mobile device to display a graphical user interface configured to enable a user to alter settings of the electronic padlock.

15 Claims, 12 Drawing Sheets

Related U.S. Application Data

(60) Provisional application No. 62/108,955, filed on Jan. 28, 2015.

(52) U.S. Cl.
CPC .. *E05B 2047/0095* (2013.01); *G07C 9/00571* (2013.01); *G07C 2009/00865* (2013.01); *G07C 2209/08* (2013.01)

(58) Field of Classification Search
CPC . G07C 9/00571; E05B 67/02; E05B 47/0001; E05B 2047/0048
See application file for complete search history.

(56) References Cited

U.S. PATENT DOCUMENTS 3,838,395 A 9/1974 Suttill
4,499,462 A 2/1985 Stoesser
5,646,605 A 7/1997 Leonaggeo
6,411,195 B1 6/2002 Goldman
6,442,983 B1 9/2002 Thomas
6,505,774 B1 1/2003 Fulcher
6,898,952 B1 5/2005 Lin
6,989,732 B2 1/2006 Fisher
7,021,092 B2 4/2006 Loughlin
7,236,085 B1 6/2007 Aronson
7,423,515 B1 9/2008 Fiske
8,274,365 B2 7/2012 Piccirillo
8,477,011 B2 7/2013 Tubb
8,791,790 B2 7/2014 Robertson
8,850,858 B2 10/2014 Nave
8,875,550 B1 11/2014 Spunt
8,881,558 B2 11/2014 Misner
8,919,024 B2 12/2014 Milde
8,922,333 B1 12/2014 Kirkjan
9,057,210 B2 6/2015 Dumas
9,077,716 B2 7/2015 Myers
9,109,379 B1 * 8/2015 Ranchod ..... E05B 67/00
9,115,511 B1 8/2015 Schmidt
9,121,199 B2 * 9/2015 Li ..... E05B 47/06
9,437,062 B2 9/2016 Ahearn
9,495,820 B1 11/2016 Li
9,728,022 B2 8/2017 Gengler
9,747,739 B2 8/2017 Gengler
2002/0088256 A1 * 7/2002 Taylor ..... E05B 37/16 70/25
2003/0011719 A1 1/2003 Jang
2003/0016847 A1 1/2003 Quintana
2004/0064309 A1 4/2004 Kosai
2004/0108938 A1 6/2004 Entrekin
2005/0099262 A1 * 5/2005 Childress ..... G07C 9/00309 340/5.6
2005/0201076 A1 9/2005 Marcelle
2005/0210283 A1 9/2005 Kato
2005/0213441 A1 * 9/2005 Voltz ..... G11B 17/05 369/30.36
2006/0061549 A1 6/2006 Chen
2006/0179903 A1 * 8/2006 Goldman ..... E05B 47/0002 70/278.7
2006/0283216 A1 12/2006 Marcelle
2006/0288744 A1 12/2006 Smith
2007/0017977 A1 1/2007 Ueda
2007/0126551 A1 6/2007 Slevin
2007/0132552 A1 6/2007 Kurpinski
2007/0216764 A1 9/2007 Kwak
2007/0229257 A1 10/2007 Bliding
2008/0024272 A1 1/2008 Fiske
2008/0047783 A1 2/2008 Vogl
2008/0068128 A1 3/2008 Ghabra
2008/0100417 A1 5/2008 Hata
2008/0118014 A1 5/2008 Reunamaki
2008/0129473 A1 6/2008 Tsuruta
2008/0136587 A1 * 6/2008 Orr ..... G08C 19/00 340/5.31
2008/0215841 A1 9/2008 Bolotin
2008/0230086 A1 9/2008 Murphy
2008/0252415 A1 10/2008 Larson
2009/0153291 A1 6/2009 Larson
2009/0189747 A1 7/2009 Baier
2009/0256676 A1 10/2009 Piccirillo
2009/0261945 A1 10/2009 Ko
2009/0312051 A1 12/2009 Hansson
2010/0053861 A1 3/2010 Kim
2010/0073129 A1 3/2010 Pukari
2010/0083713 A1 4/2010 Woodling
2010/0158327 A1 * 6/2010 Kangas ..... G06F 21/316 382/124
2010/0166207 A1 7/2010 Masuyama
2010/0222940 A1 9/2010 Putsch
2010/0245289 A1 9/2010 Svajda
2010/0306718 A1 12/2010 Shim
2011/0001603 A1 1/2011 Willis
2011/0090047 A1 4/2011 Patel
2011/0259063 A1 10/2011 Foti
2012/0011902 A1 1/2012 Meekma
2012/0186308 A1 7/2012 Garthe
2012/0229251 A1 9/2012 Ufkes
2012/0280783 A1 11/2012 Gerhardt
2012/0306748 A1 12/2012 Fleizach
2012/0312956 A1 12/2012 Chang
2012/0324967 A1 12/2012 Goren
2012/0324968 A1 12/2012 Goren
2013/0021273 A1 1/2013 Lee
2013/0055773 A1 3/2013 Li
2013/0076206 A1 3/2013 Rosenberg
2013/0099893 A1 4/2013 Kulinets
2013/0110264 A1 5/2013 Weast
2013/0118216 A1 5/2013 Kalous
2013/0127706 A1 5/2013 Hsu
2013/0169549 A1 7/2013 Seymour
2013/0203348 A1 8/2013 Lim
2013/0257590 A1 10/2013 Kuenzi
2013/0257716 A1 10/2013 Xin
2013/0293368 A1 11/2013 Ottah
2013/0332848 A1 12/2013 Lam
2013/0335193 A1 * 12/2013 Hanson ..... H04W 12/06 340/5.61
2013/0342314 A1 12/2013 Chen
2014/0015737 A1 1/2014 Inoue
2014/0028443 A1 1/2014 Ebner
2014/0056033 A1 2/2014 Woo
2014/0077929 A1 3/2014 Dumas
2014/0109631 A1 4/2014 Asquith
2014/0113563 A1 4/2014 Almonani
2014/0150502 A1 6/2014 Duncan
2014/0195841 A1 7/2014 Lee
2014/0210592 A1 7/2014 Van Wiemeersch
2014/0218167 A1 8/2014 Tseng
2014/0250954 A1 * 9/2014 Buzhardt ..... E05B 39/04 70/20
2014/0260452 A1 9/2014 Chen
2014/0265359 A1 9/2014 Cheng
2014/0266588 A1 9/2014 Majzoobi
2014/0292481 A1 10/2014 Dumas
2014/0310653 A1 10/2014 Han
2014/0326027 A1 11/2014 Avganim
2014/0360232 A1 12/2014 Al-Kahwati
2014/0375422 A1 12/2014 Huber
2015/0076989 A1 3/2015 Walma
2015/0102902 A1 4/2015 Chen
2015/0120151 A1 4/2015 Akay
2015/0143260 A1 5/2015 Bailey
2015/0168099 A1 6/2015 Hyde
2015/0170447 A1 6/2015 Buzhardt
2015/0178532 A1 6/2015 Brule
2015/0220918 A1 8/2015 Davis
2015/0225986 A1 8/2015 Goldman
2015/0240531 A1 8/2015 Blust
2015/0278124 A1 10/2015 Bolotin
2015/0292244 A1 * 10/2015 Beatty ..... E05B 47/0012 70/20
2016/0002953 A1 1/2016 Sada

(56) References Cited

U.S. PATENT DOCUMENTS

| | | | | |
|---|---|---|---|---|
| 2016/0035163 | A1* | 2/2016 | Conrad | G07C 9/00309 340/5.61 |
| 2016/0042582 | A1 | 2/2016 | Hyde | |
| 2016/0047142 | A1 | 2/2016 | Gengler | |
| 2016/0142093 | A1 | 5/2016 | Phang | |
| 2016/0217637 | A1 | 7/2016 | Gengler | |
| 2016/0299680 | A1 | 10/2016 | Polyulya | |
| 2016/0330244 | A1 | 11/2016 | Denton | |

FOREIGN PATENT DOCUMENTS

| | | |
|---|---|---|
| WO | WO2007020574 | 2/2007 |
| WO | WO2013170292 | 11/2013 |
| WO | WO2013189721 | 12/2013 |

OTHER PUBLICATIONS

AMADAS, "AMADAS Smart Lock: The Truly UserCentric", Per KickStarter Jul. 2014 Idea & design; Protoype in Jan. 2015; (not availableon Wayback Machine) https://www.kickstarter.com/projects/2033716885/amadas-smart-lockthe-truly-user-centricsecurity? ref=nav_search, Jul. 31, 2014.

BitLock, "Toss your bike key with BitLock Bluetooth lock", https://www.cnet.com/news/toss-your-bike-key-with-bitlock-bluetoothlock/, Oct. 15, 2013.

Ha, "Are Smart Locks Secure, or Just Dumb?", http://gizmodo.com/aresmart-locks-secure-or-just-dumb-511093690, Jun. 5, 2013.

Lockitron, "Lockitron turns your smartphone into a house key", http://newatlas.com/lockitron-turns-yoursmartphone-into-a-housekey/24422/, Oct. 4, 2012.

Padlock Evolution, "The padlock evolution", From ProQuest, Apr. 1999.

PR100, "PR100", http://www.assaabloyamericasuniversity.com/Other/AssaAbloyAmericasUniv/Lesson%20Resources/SARAperioHowToOrder/PR100%20Catalog%20For%20Training.pdf, 2012.

Ritchie et al, "The future of authentication: Biometrics, multi-factor, and co-dependency", http://web.archive.org/web/20131210115341/http://www.androidcentral.com/talk-mobile/future-authentication-biometrics-multi-factor-and-codependency-talk-mobile, Dec. 10, 2013.

Saluki, "Project Proposal Generic Wireless Lock",http://www.engr.siu.edu/ugrad/me495a/S13-GLCK/Documentation/[495]%20Proposal%20s13_44_GLCK_2nd.pdf, May 2, 2013.

ShareKey, "ShareKey smartphone app replaces your house keys", http://newatlas.com/sharekey-smartphone-nfc-house-keys/25653/, Jan. 6, 2013.

Skylock, "Meet Skylock", http://web.archive.org/web/20140712040738/https://skylock.cc, Jul. 12, 2004.

Skylock2, "Skylock bike lock uses the power of the sun to thwart thieves and connect to riders", http://newatlas.com/skylock-solarpowered-bike-lock/32157/, May 20, 2014.

Supraekey, "Real-Time Wireless Key Management", http://www.supraekey.com/Documents/Realtime_Wireless.pdf, 2010.

Teo, "Teo Bluetooth Padlock lets you secure school lockers, chains & gates with Apple's iPhone", http://appleinsider.com/articles/14/01/11/teobluetooth- padlock-lets-you-secure-school-lockers-chains-gates-withapples-iphone, Jan. 11, 2014.

Todorovic, "Lockbox realtor's dream", From ProQuest, Sep. 17, 2005.

UniKey, "UniKey replaces physical door lock key with an app", http://newatlas.com/unikey-door-lock-app/22635/, May 22, 2012.

Paoli, "Betty Brachman's connections", From Proquest, Oct. 8, 2000.

Woollaston, "The smart lock that lets you open your front door using just your phone—and can even let in guests when you're not home", http://www.dailymail.co.uk/sciencetech/article-2333375/The-smart-locklets-open-door-using-just-phone--let-guests-youre-home.html, May 30, 2013.

Youtube, "2 Factor Authentication Lock", https://www.youtube.com/watch?v=qm7NaEbcoLA, Dec. 3, 2013.

PCT International Search Report; International App. No. PCT/US2015/045541; dated Jan. 12, 2016.

USPTO Notice of Allowance; U.S. Appl. No. 14/610,578; dated Jun. 16, 2017.

USPTO Non-final Office Action; U.S. Appl. No. 14/610,578; dated Dec. 14, 2016.

USPTO Non-final Office Action; U.S. Appl. No. 14/610,578; dated Apr. 15, 2016.

USPTO Non-final Office Action; U.S. Appl. No. 14/610,578; dated Apr. 8, 2015.

USPTO Final Office Action; U.S. Appl. No. 14/610,578; dated Nov. 19, 2015.

USPTO Final Office Action; U.S. Appl. No. 14/610,578; dated Jul. 29, 2016.

USPTO Non-final Office Action; U.S. Appl. No. 15/009,640; dated Dec. 22, 2016.

USPTO Notice of Allowance; U.S. Appl. No. 15/009,640; dated Jun. 15, 2017.

U.S. Appl. No. 15/669,807, Non-Final Office Action dated Dec. 28, 2017.

U.S. Appl. No. 15/669,807, Final Office Action dated Jul. 17, 2018.

U.S. Appl. No. 15/669,807, Notice of Allowance dated Oct. 17, 2018.

* cited by examiner

ELECTRONIC PADLOCKS AND RELATED METHODS

RELATED APPLICATIONS

This application claims priority to U.S. Provisional Application 62/108,955 to Gengler et al., filed Jan. 28, 2015, the entire disclosure of which is hereby incorporated herein by this reference. The subject matter of this application is also related to U.S. patent application Ser. No. 14/610,578 to Gengler et al., filed Jan. 30, 2015, the entire disclosure of which is also hereby incorporated herein by this reference.

TECHNICAL FIELD

The present disclosure relates to locking devices and more specifically to locking devices configured to communicate over wireless channels.

DETAILED DESCRIPTION OF PREFERRED EMBODIMENTS

Figure 1:
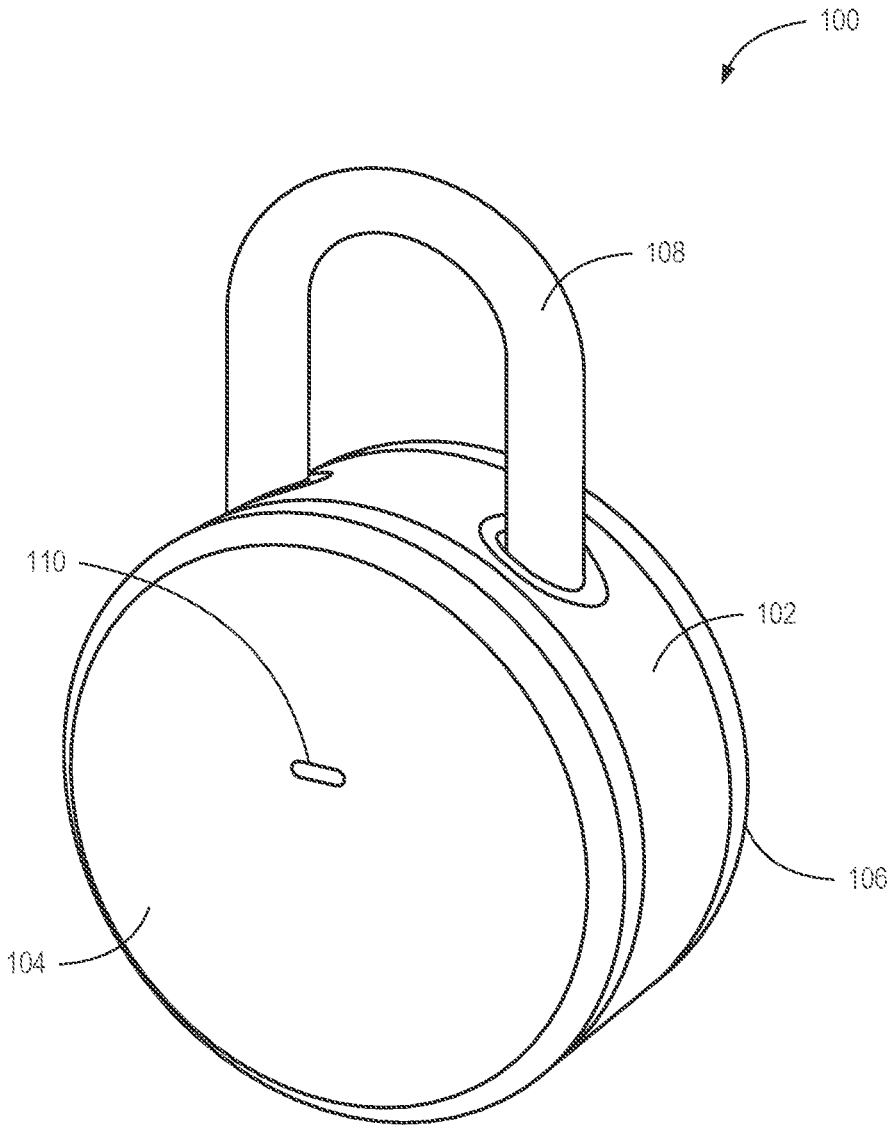
FIG. 1 is a perspective view illustrating an electronic locking device, according to one embodiment.

A detailed description of systems and methods of the present disclosure is provided below. While several embodiments are described, it should be understood that the disclosure is not limited to any one embodiment, but instead encompasses numerous alternatives, modifications, and equivalents. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure.

Techniques, apparatus, and methods are disclosed that enable an electronic locking device to become active from a low power state (such as a sleep state or a zero power state), receive physical input to unlock (such as through a physical interface), and provide access to a replaceable power supply. In one embodiment, an electronic locking device can use a combination of physical input and discovery of an authorized mobile device to enable transition from a locked state to an unlocked state. The electronic locking device can receive a physical input, causing the electronic locking device to transition from a low power state to an active state. The electronic locking device can determine if a wireless device, such as a smartphone or key fob, is present. If a wireless device is present, the electronic locking device can determine whether the wireless device is authorized to unlock the electronic locking device. If the wireless device is authorized, the electronic locking device can transition to an unlocked state. Throughout the specification, the terms "lock," "electronic lock," "electronic locking device," "electronic padlock," and the like are used interchangeably.

For example, an electronic lock can be placed on a locker. A user pushes on a u-bend shank (or similar, such as a square, triangular or alternative shank or shackle shape) at the top of the electronic lock and on a bottom of a cylinder of the lock, causing the u-bend to move toward the cylinder of the lock. The movement of the u-bend can cause an end of the u-bend to contact an electronic switch. The switch can provide a signal that causes a processor in the electronic lock to transition from a sleep state to an awake state. The processor can cause a Bluetooth™ low power beacon to be transmitted. A smartphone configured with an application to access a locking service can respond to the beacon. As part of the response and/or negotiation, the smartphone can provide an authorization payload (e.g., a token, key, and/or code) proving authorization to access the electronic lock. Upon verifying the authorization (e.g., by preconfiguration or contacting a service over a second communication channel), the electronic lock can transition from a locked state to an unlocked state and release a locking mechanism. In one example, the lock can be re-engaged by resetting the u-bend into the cylinder of the lock and pressing the u-bend into the cylinder. The pressing of the u-bend can cause the switch to activate and the lock to transition from an unlocked state to a locked state and lock the locking mechanism.

In some embodiments, the electronic lock does not require physical input. The electronic lock can send out a beacon over a long duration interval to conserve battery power (e.g., one-second intervals). A mobile device can respond to the beacon and prove authorization to access the electronic lock. Upon confirmation of the authorization, the electronic lock can transition from a locked state to an unlocked state and release a locking mechanism. Examples of mobile devices include a cell phone, wireless keychain fob, personal digital assistant, music player, etc.

An authorized mobile device may also be required to be within a certain distance to cause the electronic lock to transition from a locked state to an unlocked state. The distance may be estimated based on the signal strength of the beacon sent by the electronic locking mechanism. For example, if the electric lock is communicating with the mobile device via Bluetooth™, the signal received by the mobile device may be required to reach a certain decibel level before the mobile device sends a confirmation of the authorization.

The signal strength required may be controlled by an application installed on the mobile device. For example, the application may contain a sliding scale that allows the user to select a certain distance. Once the mobile device enters within the defined area, the electronic locking device will unlock. The user may also have the ability to turn off the automatic unlocking feature and require a physical input such as touching the electronic lock or touching a button on the mobile device to pair the two.

The electronic lock may be capable of receiving input to prevent it from unlocking immediately after the device is locked while an authorized electronic device is present. The electronic lock may enter a state where it is not capable of being unlocked again until a certain time has passed. This may be initiated by locking the device, the user holding down the u-bar, a double click of the u-bar, or other similar input. For example, a person using the electronic lock for a gym lock may engage the lock and, in order to leave the locker room without unlocking it, begin a two-minute timer on the electronic lock by holding down the u-bar. While the timer is running, the lock will not unlock. This would give the user sufficient time to leave the zone in which the electronic device would automatically unlock or in which a third party might unlock the device against the owner's wishes.

The beacon sent out by the electric lock may also be used to assist finding the lock. For example, an authorized electronic device, such as a smartphone, may provide the user with an indication of the lock's last known location, such as, for example, on a map. If the user cannot find the electric lock by examining the indicated area, the electronic device may detect the signal strength and use that to guide the user to the electric lock. For example, as the user moves, the electronic device may detect an increase in signal strength from the electronic lock and thereby indicate to the user to continue in that direction.

In another embodiment, an electronic locking device can match a series of long and/or short physical interactions to a series of stored interactions to enable the transition from a locked state to an unlocked state. The electronic locking device can detect a first physical interaction that causes it to transition from a low power state to an active state. In some embodiments, an indicator (such as an LED light or sound) can indicate the transition is complete. A user can then interact with the locking device through a series of long and/or short physical input interactions. When a series of physical input actions matches a stored set of input actions, the electronic locking device can transition from a locked state to an unlocked state and release a locking mechanism.

For example, an electronic padlock can be placed on a hasp to secure a shed door. A user can touch a capacitive touch-sensing front panel to cause the electronic padlock to wake from a sleep state. The electronic padlock can flash a green light and/or sound a short beep to indicate the lock is ready for input. Having set a stored code of long touches and short touches beforehand (such as through an application on a smartphone or a locking service), a user can repeat the code to the lock by touching the capacitive touch-sensing front panel. If the input code matches the stored code, the lock can transition from a locked state to an unlocked state and release a captured shackle (also known as a shank). When a user determines that the electronic padlock should be locked again, the user can replace the shackle and touch the touch-sensing front panel to cause the electronic padlock to transition to a locked state from an unlocked state and recapture the shackle.

Various sensors can be used to provide input to the electronic locking device alone or in combination through a physical interface. Physical inputs can include use of accelerometers (e.g., activated by shaking and/or movement of a lock), light sensors (e.g., activated by waving a hand between a light source and/or the lock), infrared sensors (e.g., activated by waving a hand in front of the lock), front buttons (e.g., activated by pushing on a front of the lock body), shank buttons (e.g., activated by pushing the shank into the lock body), switches (e.g., activated by pushing a spring-loaded switch to a second position that returns to a first position), capacitive touch sensors (e.g., activated by touching a panel and/or lock body), resistive touch sensors (e.g., activated by pressing on a panel), light-based touch sensors (e.g., activated by breaking a beam across the lock body), etc.

A combination of sensors can also be used. In one embodiment, a light sensor is used in combination with an accelerometer. The lock can remain in a low power state until both the light sensor detects a change in light and the accelerometer detects shaking of the device. This combination can help preserve battery power, such as on occasions when a lock is in a backpack. A sole accelerometer input might cause the lock to wake up when the backpack is jostled during walking or riding a bike. With both sensors, however, the light may remain dim while in the backpack, causing the lock to remain in a low power state. Electronic inputs can include use of wireless local area network (WLAN) interface (also known as WiFi), Bluetooth™, ZigBee™, Ethernet, USB, Long Term Evolution (LTE™), near field communication (NFC), etc.

Input received by the sensors may cause the electronic locking mechanism to perform certain functions. In one embodiment, if the accelerometer or shank button wakes the electronic locking device and an authorized device is not present, an alarm sounds. The alarm may either be a sound such as a scream, siren, etc., or be in the form of a notification to the owner of the lock. The notification may be sent to the owner's device via WiFi™, Bluetooth™, LTE™ or other communication standard. For example, if Bluetooth™ is used, accelerometer data may be stored and once an owner comes within range, the electronic locking device may send the stored data to the owner.

In some embodiments, the electronic padlock can first attempt to connect to an authorized electronic device. For example, after receiving the input from a capacitive touch sensor, the electronic padlock can transmit one or more Bluetooth™ beacons indicating the lock is awake. After receiving no response, the electronic padlock can then indicate to a user that it is available for physical input attempts by lighting the green light and/or sounding the short beep. In one embodiment, the lock can continue to send out Bluetooth™ beacons. In other embodiments, the electronic padlock may use an indicator and a user must wait a set amount of time (such as one second) before the padlock is ready to receive input.

In some embodiments, the electronic padlock can be reset so that another code can be attempted. In an embodiment, if an input code is incorrectly input, the lock will reset if no activity is sensed for two seconds. In one embodiment, an extra-long press held for two seconds will reset the electronic padlock. In other embodiments, the electronic padlock gives an indication of success or failure by emitting a red light and/or long beep. In yet another embodiment, the electronic lock views inputs as a stream and will unlock when the stream matches a stored series.

In a third embodiment, an electronic locking device can provide access to a replaceable power supply. The electronic locking device can include a hole in which a small rod can be inserted (e.g., a paper clip). The rod can contact a latch mechanism that releases a latch on a battery cover of the electronic locking device. When the latch is released, the battery cover can be removed. In some embodiments, the latch is self-locking such that when the battery cover is replaced, the latch locks automatically (e.g., mechanically, electrically, etc.).

In one embodiment, an electronic locking device can provide access to a replaceable power supply when unlocked. For example, a rod can extend from the lock body to engage a lock back that covers the power supply. When engaged, the rod prevents the threaded lock back from twisting. By preventing the twisting, the lock back remains locked to the lock body. When unlocked, the rod can move back toward the lock body. As the rod is disengaged from the lock back, the lock back is free to rotate on threaded lock body and be removed.

In an embodiment, an electronic lock can include physical means for unlocking. In one embodiment, the electronic lock can include a physical key access that allows the lock to be unlocked in addition to electronic means as described above (e.g., mobile device, code entry, etc.). In some embodiments, the physical access can be limited by the presence or absence of power (e.g., dead battery).

In some embodiments, disclosed herein is an electronic padlock. The electronic padlock includes a lock body having at least one shank entrance formed therein, and a shank received by the lock body through the at least one shank entrance. The electronic padlock also includes a locking mechanism housed within the lock body and configured to selectively secure the shank in a locked position and release the shank from the locked position. The electronic padlock also includes electronic circuitry operably coupled to the locking mechanism and configured to detect the physical interactions of the user with the shank and control the locking mechanism to at least one of secure the shank in the locked position and release the shank from the locked position.

In some embodiments, disclosed herein is a method of operating an electronic padlock. The method includes detecting physical interactions of a user with a shank of an electronic padlock, and comparing the detected physical interactions with a stored predetermined series of physical interactions. The method also includes transitioning from a locked state to an unlocked state responsive to determining that the detected physical interactions match the predetermined series of physical interactions.

In some embodiments, disclosed herein is a method of transforming a mobile device into a device configured to interface with an electronic padlock. The method includes distributing computer-readable instructions to a mobile device, the computer-readable instructions configured to instruct one or more processors of the mobile device to perform operations. The operations include displaying a graphical user interface on an electronic display of the mobile device. The graphical user interface is configured to enable a user of the mobile device to alter settings of an electronic padlock. The operations also include displaying user-selectable options on the electronic display. The user-selectable options are configured to enable the user to define at least one predefined series of physical interactions of the user with a shank of the electronic padlock to authorize the electronic padlock to perform at least one function. The operations also include wirelessly transmitting data indicating the at least one predefined series of physical interactions to the electronic padlock.

It should be recognized that an electronic locking device can be a lock. Locks can take various forms, such as a padlock as shown in FIG. 1, having a horizontal cylindrical shape. Other shapes are also possible, such as cubic shapes, trapezoid shapes, vertical cylindrical shapes, etc. While the application focuses on a padlock embodiment (such as seen in FIG. 1), other locks can be used. Other locks can include u-locks (such as a bicycle lock), cable locks, key boxes (such as a wall-mounted lock box), lockers (such as a gym locker), etc.

FIG. 1 is a perspective view illustrating an electronic locking device 100 consistent with various embodiments disclosed herein. The electronic locking device 100 can be a padlock that includes a lock body 102, a front end cap 104, a back end cap 106, and a shank 108. An LED status light 110 can show status by displaying multiple colors, multiple blink patterns, solid lights, and/or nothing. The status light 110 can show states including waking up, going to sleep, locked, unlocked, entry type (e.g., short or long), successful password, unsuccessful password, communication speed, communication status, channel, connectivity, and/or reset.

Electronics can be housed inside the lock body 102, and antennas can be built into the circuit boards and/or the external case (such as the lock body 102, the end cap 104 or 106, or the shank 108). In one embodiment, the front end cap 104 includes an antenna strip. In another embodiment, the back end cap 106 is configured to be transparent to wireless signals. In yet another embodiment, a solar panel may be built into the external case to charge the battery.

In some embodiments, the end caps 104 and 106 can be removed. In one example, the end caps 104 and 106 can be removed when in an unlocked state, but not when in a locked state. For instance, when the shank 108 is in a locked position, it may push a pin laterally against the end caps 104 and 106. The end caps 104 and 106 may have a recess where the pin enters and prevents the end caps 104 and 106 from being unscrewed. In another example, the front end cap 104 can only be removed in an unlocked state, but the back end cap 106 can be removed to expose a removable battery (such as described above). Other combinations are also possible.

Figure 2C:
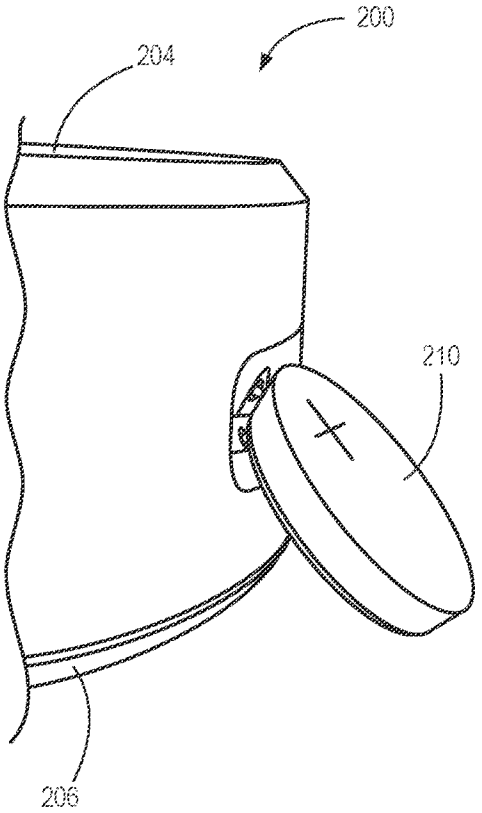
FIGS. 2A-2C are perspective views of an electronic locking device receiving power from an external battery.
Figure 2B:
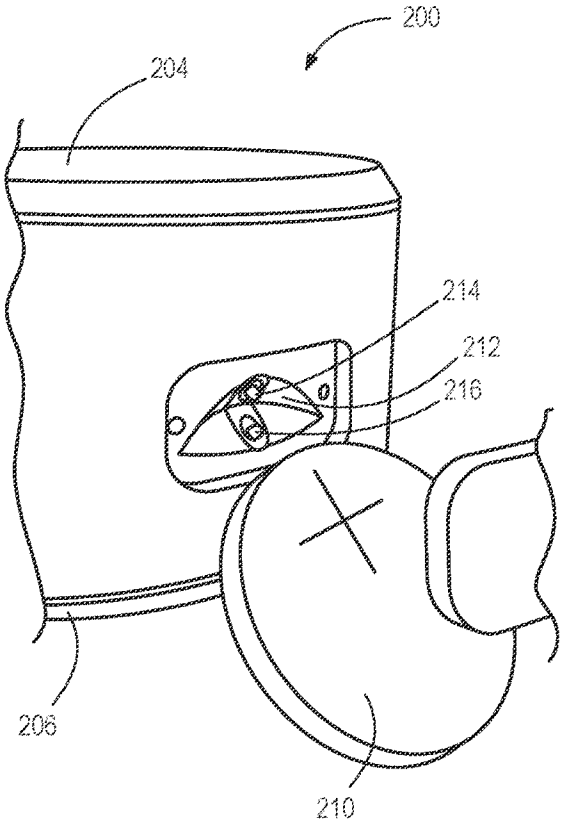
Figure 2A:
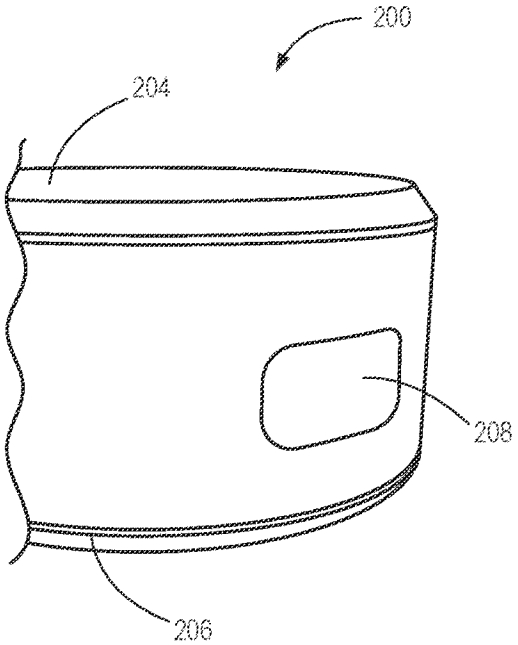

FIGS. 2A-2C are perspective views of an electronic locking device 200 receiving power from an external battery 210. As discussed above, in some embodiments the end caps 204 and 206 may only be removed when in an unlocked state. The external battery 210 is capable of jump starting the electronic locking device 200 when the internal removable battery cannot provide sufficient power to transition the device to an unlocked state. That is, the external battery 210 may be used to provide supplemental, emergency, or backup power to the locking device 200 and/or be used to charge an internal battery, capacitor, or other energy source used to power the locking device 200. Thus the electronic locking device 200 can be unlocked and the removable battery enclosed within the end caps 204 and 206 can be replaced.

For example, the electronic locking device 200 may be used to secure a bicycle. In such a situation, the internal battery may eventually lose its charge due to use, or in cold weather if it freezes. If the internal battery loses its charge, a user may remove a cover 208 that conceals a slot 212 capable of receiving a charge from the external battery 210. For instance, FIG. 2B shows the slot 212 after the cover 208 in FIG. 2A has been removed. After the slot 212 is exposed, the external battery 210 may be pressed against contact points 214 and 216 as shown in FIG. 2C. The contact may induce an electrical current between the external battery 210 and the electronic locking device 200. The external battery 210 may thereby provide the electronic locking device 200 with sufficient power to change into an unlocked state. At this point a user a user can remove the end cap 206 and replace the internal battery.

Figure 3B:
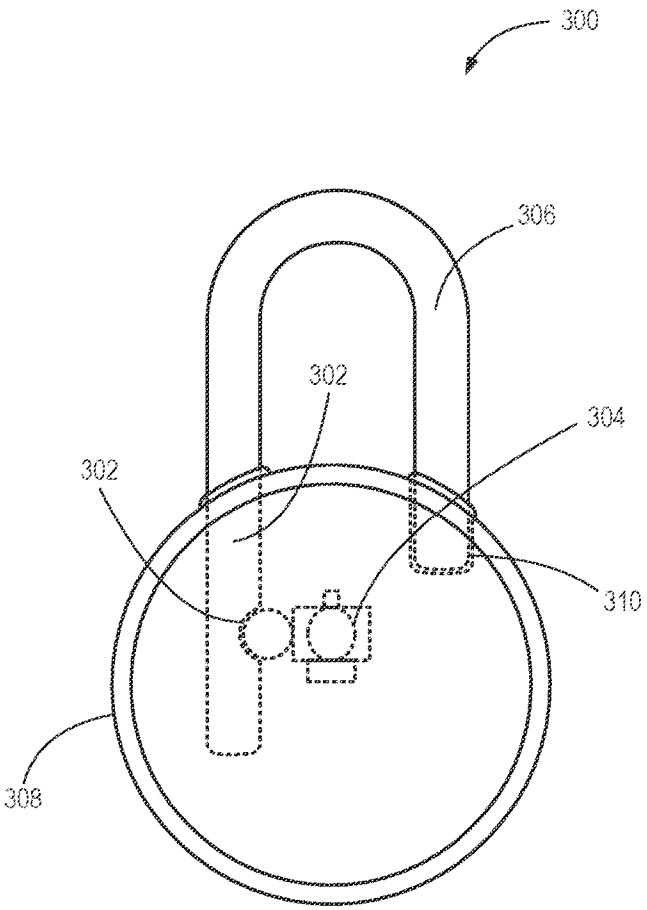
FIGS. 3A and 3B are frontal views of an electronic locking device with an alternative single notch and post locking mechanism.
Figure 3A:
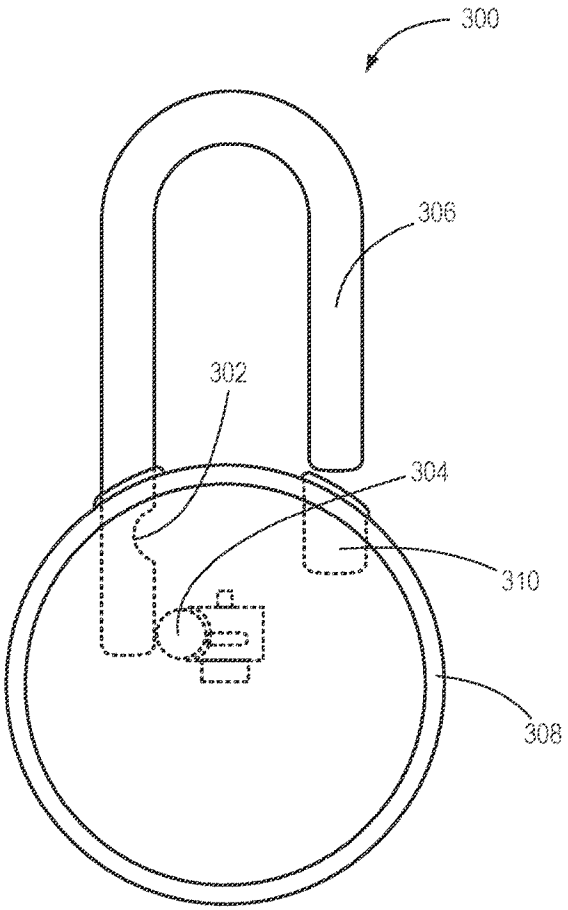

FIGS. 3A and 3B are frontal views of an electronic locking device 300 with an alternative single notch 302 and post locking mechanism 304. In some instances, the electronic locking device 300 may be used in a location where moisture, such as rain, is present. Therefore, it may be necessary to weather seal or waterproof the electronic locking device 300. This may be accomplished by utilizing the single notch 302 and post locking mechanism 304.

In order to remove the electronic locking device 300 from a secured location, the shank 306 is extended away from the body 308 until one end of the shank 306 is removed from the body 308. With a traditional double notch locking system (i.e., the shank has a notch on both sides), the end of the shank that is removed from the body may collect moisture. When the end of the shank 306 is introduced back into the body 308, moisture is then introduced into the electronic locking device 300. This introduction of moisture may be prevented by using the alternative single notch 302 and post locking mechanism 304 as shown.

For example, the side of the shank 306 that is capable of being removed from the body 308 may be a sealed dummy hole 310. Instead of entering the body 308 after being removed, the end of the shank 306 may enter a hole that has been sealed to the elements. The hole may be formed from the same material as the body 308, or it may be silicone or some other material capable of preventing water intrusion.

In order to keep the electronic locking device 300 in a locked position, there may be a notch 302 and a post on the other side of the shank 306. This side of the shank 306 may also be designed to prevent water intrusion. For example, a silicon seal may be used to prevent moisture from entering into the body 308. Further, the notch 302 in the shank 306 may be placed low enough that it never reaches the silicone seal. This would allow the silicon seal to be tightly fitted to the shank 306 in order to prevent moisture intrusion.

Figure 4:
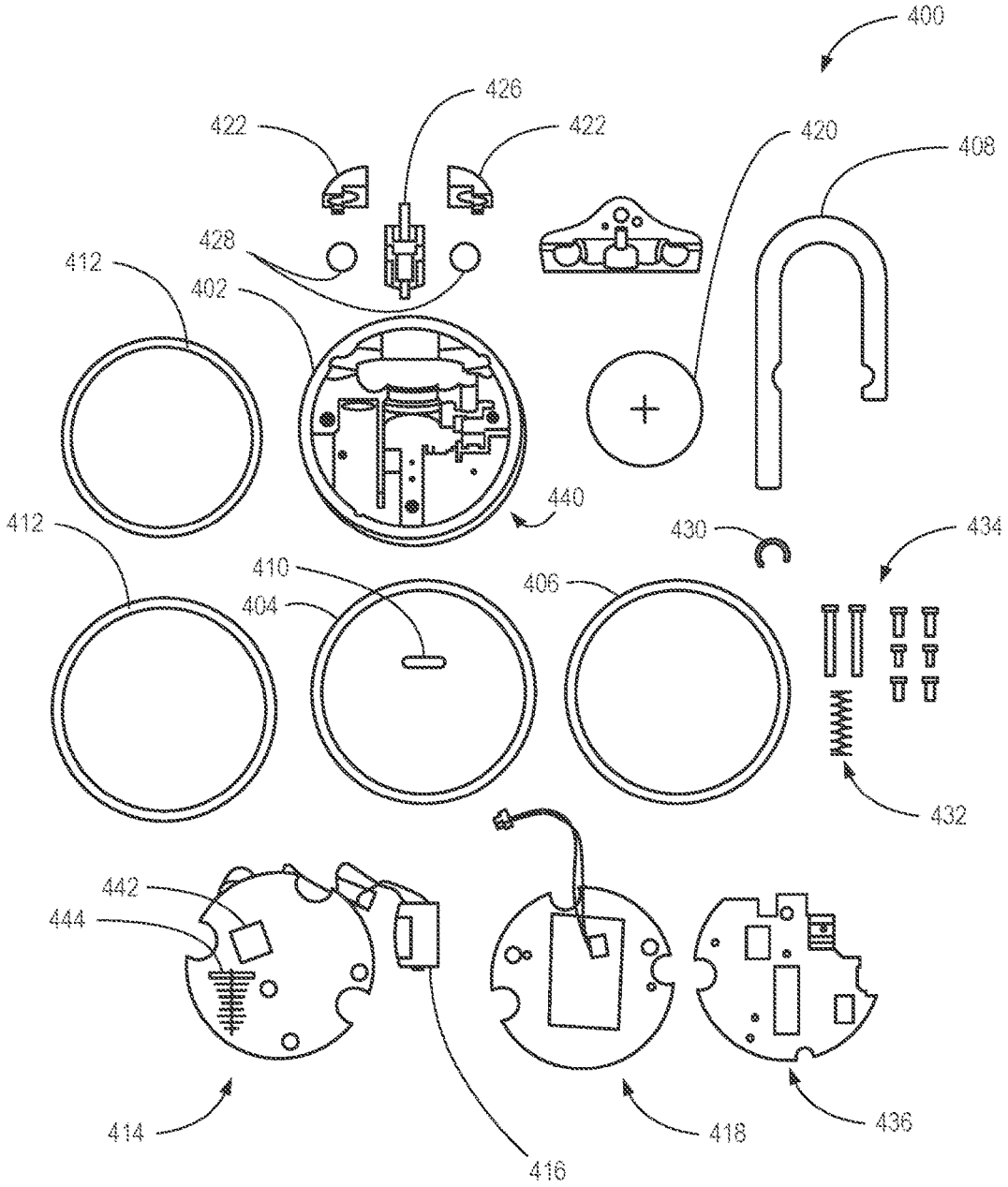
FIG. 4 is an exploded diagram illustrating the electronic locking device of FIG. 1, according to one embodiment.

FIG. 4 shows an exploded diagram of an embodiment of the electronic locking device shown in FIG. 1. In the embodiment shown, an electronic locking device 400 can include two locking body gaskets 412, a locking body 402, a front end cap 404, a back end cap 406, a controller board 414, a motor 416, a battery board 418, a battery 420, a shank 408, two shank gaskets 422, a locking spindle 426, two ball bearings 428, a shank clip 430, a shank spring 432, four sets of screws 434, a retaining disc 436, and a shank guide.

The locking body gaskets 412 can provide weather protection between the locking body 402 and the end caps 404 and 406. In one embodiment, the locking body gaskets 412 are made from silicone. In an embodiment, the locking body gaskets 412 form a seal as the end caps 404 and 406 are tightened by screwing the threaded end caps 404 and 406 onto the locking body 402.

The locking body 402 can be formed to receive components of the electronic locking device 400. In some embodiments, the locking body 402 includes two chambers 440 separated by a wall to prevent tampering with the electronic locking device 400. A first chamber can house a locking mechanism that can only be accessed when the electronic locking device 400 is unlocked. A second chamber can house the battery 420 such that it can be accessed even when the electronic locking device 400 lacks power (e.g., a dead battery). The front end cap 404 can attach to and cover the first chamber. The back end cap 406 can attach to and cover the second chamber. The end caps 404 and 406 can attach through various methods including threading (to screw a cap onto the locking body 402), press-fit connections (to press such that a ridge of one side connects to a valley on the other side), pins, screws, latches, etc.

The controller board 414 can house a processor 442, memory, computer-readable media, wireless interfaces, antennas 444, and other supporting electronic components of the electronic locking device 400. The controller board 414 can include a Bluetooth™ low power interface and/or a WiFi™ interface. In one embodiment, the Bluetooth™ low power interface allows communication channels to be formed with mobile devices that are authorized to unlock the electronic locking device 400. In another embodiment, the WiFi interface allows channels to be formed with mobile devices that are authorized to unlock the electronic locking device 400. In an embodiment, the WiFi™ interface allows connection to a locking service through an access point. A controller on the controller board 414 can then query the service as to whether a connected mobile device is authorized to operate the electronic locking device 400 and/or grant permissions for operating the electronic locking device 400 (e.g., unlock-only, lock-only, lock/unlock, administrative access, granting permissions to other users, etc.). In some embodiments, the controller causes permissions to be stored locally on the electronic locking device 400. In other embodiments, the controller queries a locking service to determine permissions. In one embodiment, a hybrid is used such that permissions are stored locally on the electronic locking device 400 and updated from the locking service. In an embodiment, a hybrid authorization service is used such that some permissions are stored locally (e.g., unrestricted grantees) on the electronic locking device 400, while other permissions are queried from the service (e.g., restricted grantees). In another embodiment, a hybrid approach is used where the electronic locking device 400 first searches for grantee permissions locally and, if not finding them, requests permissions from the locking service. Other combinations are also possible.

It should be recognized that when a mobile device is authorized to unlock the electronic locking device 400, the authorization can be provided through several means. In one embodiment, a mobile device is "paired" (such as a Bluetooth™ pairing) such that the electronic locking device 400 can connect with a paired mobile device. Authorization to unlock is accomplished by the electronic locking device 400 verifying a presence of a paired device. In another embodiment, a pre-shared key can be used in a challenge/response scenario. Authorization can be accomplished by receiving a correct response to a challenge. The correct response causes the electronic locking device 400 to transition into an unlocked state. In yet another embodiment, an application can use a wireless interface of a mobile device to communicate with a service. Upon verifying credentials (such as a token) of the mobile device and/or position of the mobile device (such as GPS location and/or a beacon received from the electronic locking device 400), the service can provide authorization for the electronic locking device 400 to unlock.

The battery board 418 can reside in the second chamber of the locking body 402 and can provide connectivity and information about the battery 420. In one embodiment, the battery board 418 determines remaining battery life and notifies the controller of any problems. In an embodiment and if problems are detected, the battery board 418 can report the problems to a controller on the controller board 414. The controller can communicate with the locking service over a WiFi™ communications channel and transmit a message describing the problem. The locking service can then communicate the problem to a user, such as through a text message, an application notification, a phone call, an email, etc. The battery board 418 can receive a battery 420 and be covered by a back end cap 406.

The shank 408 can be used as part of a locking mechanism of the electronic locking device 400. The shank 408 can be received by the locking body 402. The shank 408 can have horizontal movement (e.g., play) reduced by the shank guide. The shank gaskets 422 can be added to reduce play and aid in weatherproofing the locking body 402 at shank 408 entrances. The shank guide can also help contain the locking spindle 426 within the locking body 402. The locking spindle 426 can include raised and recessed portions that move the ball bearings 428 outward from its axis. The locking spindle 426 can be controllably turned by the motor 416, controlled by the processor 442 on the controller board 414. When turned at a first angle relative to the locking body 402, the locking spindle 426 can be in a locking state. When in a locking state, the locking spindle 426 can cause the ball bearings 428 to be pushed within recesses of the shank 408. When the ball bearings 428 are present within the recesses of the shank 408, the shank 408 is prevented from moving out of a locked position (e.g., vertically) within the locking body 402. when turned at a second angle relative to the locking body 402, the locking spindle 426 can be in an unlocked state. When in an unlocked state, the ball bearings 428 can be pushed into the recesses of the locking spindle 426 and the shank 408 can move (e.g., vertically). The shank clip 430 may be attached to a longer end of the shank 408 to prevent the shank 408 from exiting the locking body 402. The shank spring 432 can provide vertical lift when transitioning to an unlocked state and/or resistance to locking when transitioning to a locked state. The retaining disc 436 can be placed over the locking body 402 to enclose moving parts within the locking body 402 and provide support to the moving parts (e.g., the ball bearings 428, etc.).

Various fastening technologies can be used to hold together the electronic locking device 400. In the embodiment shown, the four sets of screws 434 are used to fasten circuit boards to the locking body 402. The end caps 404 and 406 include threads that screw onto the locking body 402. However, it should be recognized that other fastening systems and/or devices can also be used.

Figure 5:
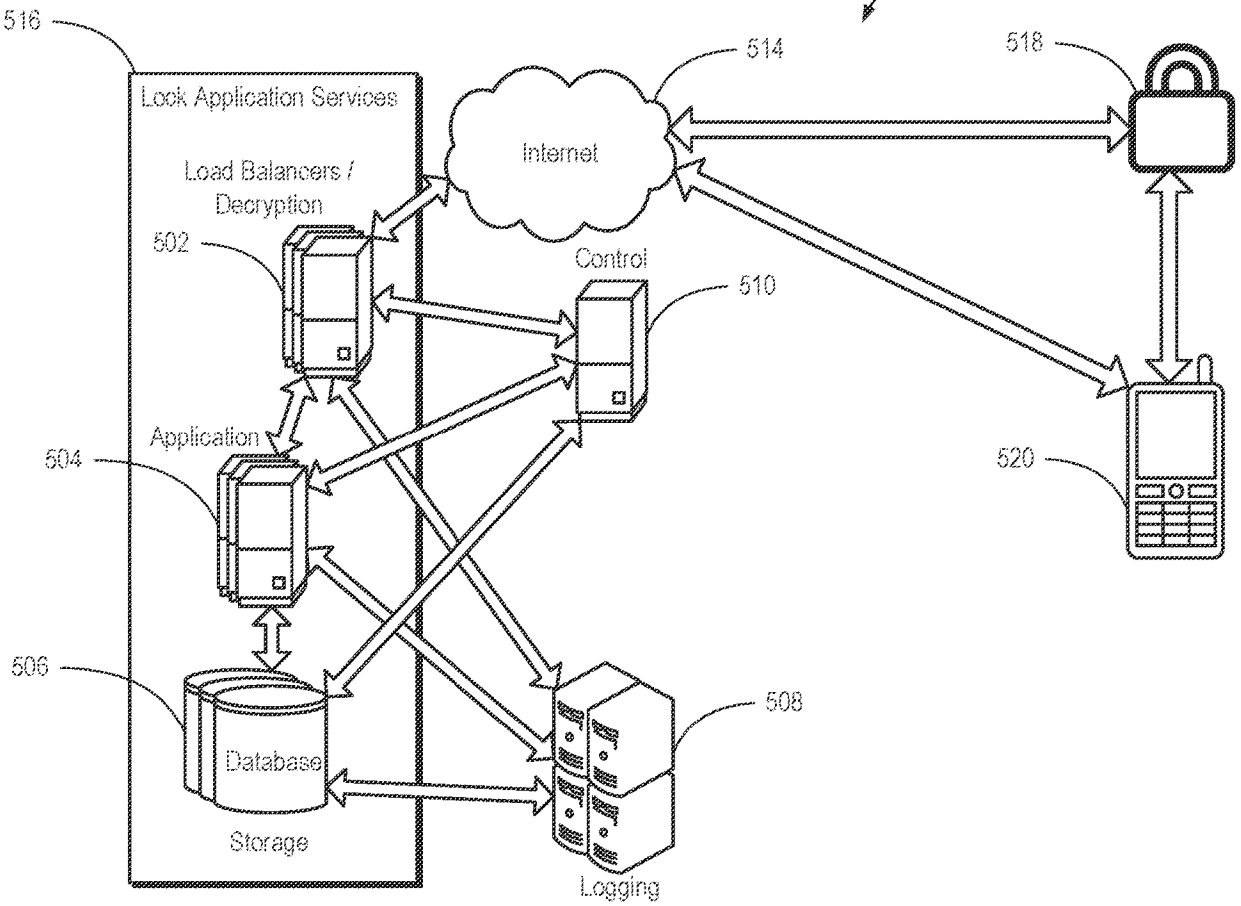
FIG. 5 is a system diagram illustrating a system configured to provide services to the electronic locking device of FIG. 1, according to one embodiment.

FIG. 5 is a system diagram illustrating a system 500 configured to provide services to the electronic locking device of FIG. 1 consistent with various embodiments disclosed herein. An electronic lock 518 can communicate with a mobile device 520 and/or a lock application service 516 (also known as a locking service) over an Internet 514 as described above. The lock application service 516 can include load balancers 502 capable of decryption, application servers 504, storage 506, control servers 510, and/or a logging service 508 (which can include one or more logging servers).

In one example, a user can set up an account with the lock application service 516 using an application on the mobile device 520. The user registers the electronic lock 518 with the lock application service 516. The lock application service 516 can store user credentials in storage 506 and associate the user credentials with an electronic lock identifier (e.g., a unique 16-digit code) for the electronic lock 518.

The user can then invite other users to join the lock application service 516 and grant joined users permissions to the electronic lock 518. Permissions can be restricted to days, times, number of times unlocking is granted, a period of time, a repeating schedule, and/or other restrictions on timing and use of the electronic lock 518. Timing restrictions may be based on the mobile device's 520 timer or on the lock application service's 516 timer, which can be accessed directly or via the mobile device's 520 Internet 514 connection. Permissions can be stored in storage 506.

The third parties may be given different levels of access. For example, an owner of the electronic lock 518 may have master authority. This level of access could allow the owner to give any permissions to third parties the owner wants. For example, if the electronic lock 518 were used to secure a gym locker and the owner wanted a friend to get into the owner's locker, the owner could give the friend's mobile device permission to access. That permission could be primary or secondary, where primary may be associated with greater privileges. For instance, a primary authority user may be able to share permissions with other people, whereas the secondary authority user could not. However, at any time the owner, due to the owner's master authority, may revoke any permissions.

Depending on the embodiment, permissions can be stored locally on the electronic lock 518 and/or in the lock application service 516. For example, when permissions are stored solely by the lock application service 516, the electronic lock 518 can be transitioned to an awake state by a user interaction and connect to the mobile device 520 over Bluetooth™. The mobile device 520 can transmit credentials to the electronic lock 518. The electronic lock 518 can send the credentials (or a message based on the credentials, e.g., a cryptographic hash) to the lock application service 516 for determination of whether the mobile device 520 is authorized to unlock the electronic lock 518. This may be done directly by the electronic lock 518 or via the mobile device's 520 Internet 514 connection. The lock application service 516 can transmit a message indicating authorization or failure to the electronic lock 518 and log the attempt in the logging service 508. If authorization is successful, the electronic lock 518 can transition to an unlocked state and release the locking mechanism. If authorization is not successful, the electronic lock 518 can stay in the same state and provide an indicator of the failure (e.g., light, sound, etc.).

Alternatively, the lock application service may not be queried every time an unlock attempt is made. For example, lock application service 516 verification for a mobile device 520 may be required every time, hourly, daily, weekly, monthly, or never. This may be defined by the owner of the electronic lock 518. The more secure the owner wishes the electronic lock 518 to remain, the more frequently the owner can require lock application service 516 verification. The security level associated with the authentication frequency requirement may be represented by a sliding scale from less secure to more secure in which the most secure option may require server or third party authentication permission each time the electronic lock 518 is accessed. The least secure option may never require server or third party authentication permission.

In another example, when permissions are stored solely by the electronic lock 518, the electronic lock 518 can be transitioned to an awake state by a user interaction and connect to the mobile device 520 over Bluetooth™. The mobile device 520 can transmit credentials to the electronic lock 518. The electronic lock 518 can determine whether the credentials match credentials available locally to the electronic lock 518. If a match is found and the user is authorized, the electronic lock 518 can transition to an unlocked state and release the locking mechanism. If the user is not authorized, the electronic lock 518 can stay in the same state and provide an indicator of the failure (e.g., light, sound, etc.).

In one example, when permissions are stored by the electronic lock 518 and the lock application service 516, the electronic lock 518 can be transitioned to an awake state by a user interaction and connect to the mobile device 520 over Bluetooth™. The mobile device 520 can transmit credentials to the electronic lock 518. The electronic lock 518 can determine whether the credentials match credentials available locally to the electronic lock 518. If a match is found and the user is authorized, the electronic lock 518 can transition to an unlocked state and release the locking mechanism. If no match is found, the electronic lock 518 can send the credentials (or a message based on the credentials, e.g., a cryptographic hash) to the lock application service 516 for determination of whether the mobile device 520 is authorized to unlock the electronic lock 518. The lock application service 516 can transmit a message indicating authorization or failure to the electronic lock 518 and log the attempt in the logging service 508. If authorization is successful, the electronic lock 518 can transition to an unlocked state and release the locking mechanism. If authorization is not successful, the electronic lock 518 can stay in the same state and provide an indicator of the failure (e.g., light, sound, etc.).

In an example, the electronic lock 518 can transition to an awake state in response to a user interaction (such as pressing on the shank). The electronic lock 518 can transmit a beacon over a first communication channel (such as Bluetooth™). The mobile device 520 can receive the beacon and transmit proof of receipt of the beacon (or a message based on the beacon, e.g., a cryptographic hash) to the lock application service 516 over a second communication channel (e.g., WiFi™). The lock application service 516 can determine whether the mobile device 520 is authorized to unlock the electronic lock 518. The lock application service 516 can transmit a message indicating authorization, if successful, to the electronic lock 518 over the second communication channel (e.g., WiFi™) and log the attempt in the logging service 508. When an authorization message is received, the electronic lock 518 can transition to an unlocked state and release the locking mechanism. If authorization is not successful, the electronic lock 518 can stay in the same state and an application on the mobile device 520 can provide an indicator of the failure (e.g., light, sound, message, etc.). In some embodiments, the beacon can be transmitted over the second communication channel and only one communication channel is used.

Logged history can be made available to a user of the electronic lock 518 (e.g., an owner, administrator, authorized user, etc.). History can include various events, attempts, and permissions related to the electronic lock 518. This can include current status of the electronic lock 518 (locked, unlocked, battery power, etc.), prior status of the electronic lock 518, user requests received, failed attempts, successful attempts, network connectivity issues, last updates, updated permissions, accelerometer data, and/or other interactions with the electronic lock 518 or the lock application service 516.

For example, a real estate agent may use the electronic lock 518 to show a property. Instead of a lock on the door requiring a potential buyer to get a physical key, the electronic lock 518 would conveniently allow the real estate agent to grant access to the property to anyone. Not only could the real estate agent provide this permission, the agent could also limit it and track how it was used. The real estate agent may view the logged history during or after a showing. For instance, the real estate agent may provide a buyer with permission to access the property between 5:50 PM and 6:50 PM. The real estate agent may be notified that the electronic lock 518 has been unlocked by the buyer at 5:55 PM and receive another notification that the electronic lock 518 has been locked at 6:15 PM.

Logged history may also be used as a timer. For example, a company renting bikes may use the time the electronic lock 518 spends unlocked to determine how much to charge a renter. For example, a renter may have a bike rental application on the renter's mobile device 520 that, at the renter's request, grants permission to unlock an electronic lock 518 storing a rental bike. The renter can then ride to the renter's destination and lock up the bike. The bike rental application may then review the logged history and charge the renter for the time the bike was unlocked.

Figure 6:
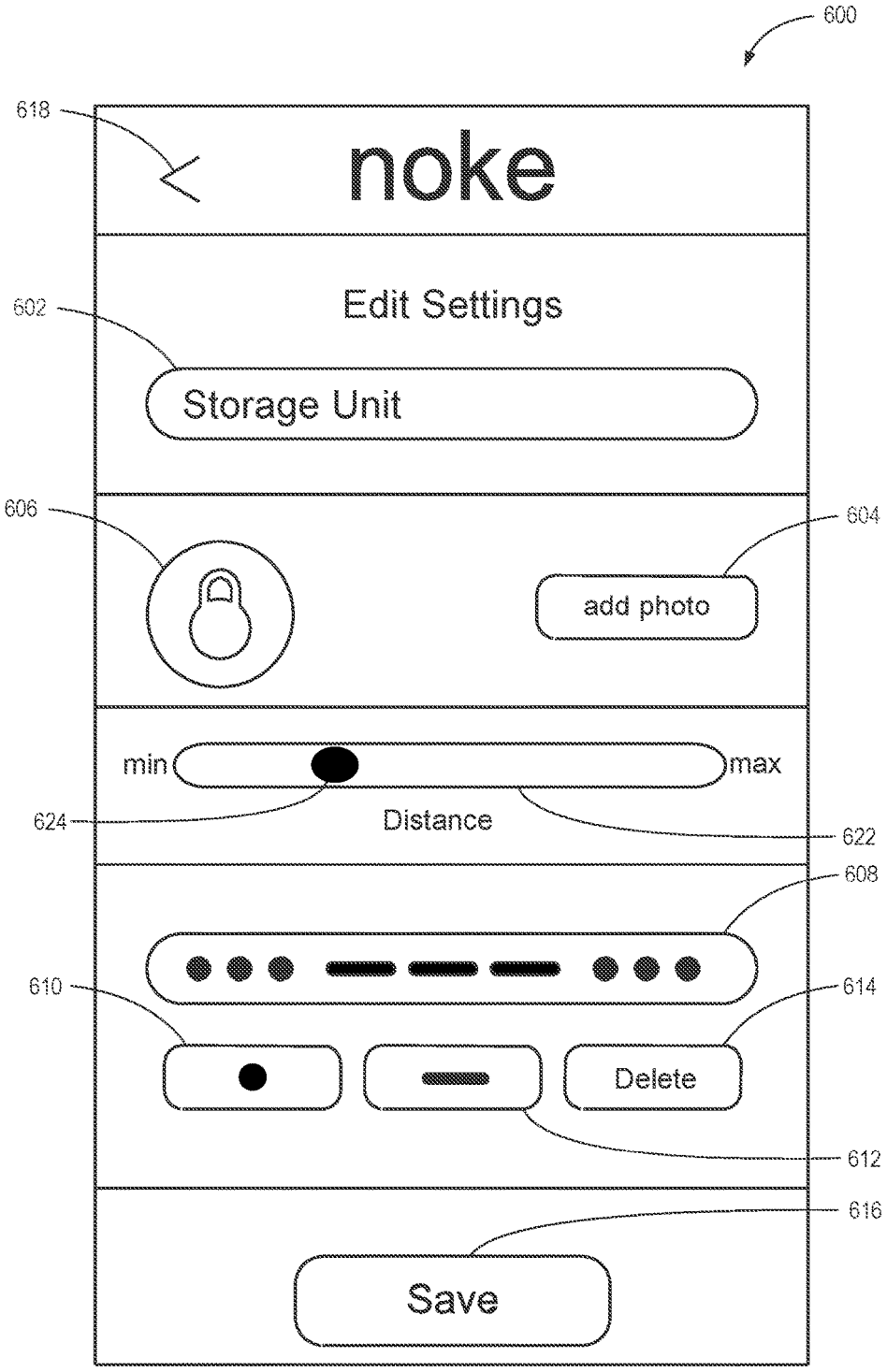
FIG. 6 is an illustration of a user interface according to some embodiments.

FIG. 6 is an illustration of a user interface 600 consistent with various embodiments disclosed herein (e.g., consistent with configuring a secondary unlocking interaction, with configuring a sliding scale for selecting a distance at which an authorized mobile device may be to unlock a lock, or combinations thereof). A user can access an application on a mobile device. In some embodiments, the application can verify user credentials with a locking service before access is allowed. In other embodiments, an electronic lock can operate without a locking service and a direct connection with the lock is established through a setup procedure (e.g., using an initial set of physical interactions to access the device).

The application can enable a user to alter settings of an electronic lock using the user interface 600 as shown in FIG. 6. A user can alter a name of the lock, provide a photograph of the lock, adjust a distance at which an authorized mobile device can unlock the lock, set a series of physical interactions that will unlock the lock, or combinations thereof. In the embodiment shown, a user can type a new name in a name field 602. A picture can be added by clicking an add photo button 604 and then taking a new photo or selecting an existing photo (such as a photo stored on the mobile device). Added pictures can then be displayed in a photo area 606.

A distance at which an authorized mobile device can unlock the lock may be controlled by a distance slider 624 on a distance scale 622 displayed on the user interface 600. The distance scale 622 may span a distance from a minimum distance to a maximum distance. The minimum distance may be, greater than or equal to as small as requiring that the mobile device and the lock be touching, or almost touching, or some other small distance between the mobile device and the lock. The maximum distance may be less than or equal to as large as a communication radius between the mobile electronic device and the lock. For example, if Bluetooth™ is used, the maximum may be about 10 meters (if the communication radius is about 10 meters). The distance slider 624 may be selectively moved anywhere between the minimum distance and the maximum distance on the distance scale 622 to set the distance at which the authorized mobile device can unlock the lock. Accordingly, the distance at which an authorized mobile device can unlock the lock may be set anywhere in the range from the minimum distance to the maximum distance.

In some embodiments, the distance between the authorized mobile device and the lock may be determined based, at least in part, on a received signal strength of communications between the mobile device and the lock (e.g., a received signal strength of signals the lock receives from the mobile device, a received signal strength of signals the mobile device receives from the lock, or combinations thereof. By way of non-limiting example, different distances between the mobile device and the lock may be correlated to different received signal strength levels (e.g., decibel power levels). A processor 442 (FIG. 4) of the lock, a processor of the mobile device, or a combination thereof may determine the distance between the mobile device and the lock.

In some embodiments, once the authorized mobile device enters within the defined distance from the lock (e.g., which may be detected by the mobile device, the lock, or a combination thereof by a received signal strength reaching a level correlated with the defined distance), the lock may unlock (e.g., automatically upon the mobile device entering within the defined distance from the lock, after further authorization steps, etc.) In some embodiments, the lock may unlock automatically responsive to a detection of the mobile device entering within the defined distance from the lock. In some embodiments, such an automatic unlocking feature may be turned on and off by the user. In some embodiments, additional authorization may be required in addition to the mobile device entering within the defined distance. By way of non-limiting example, a predetermined series of physical interactions with the lock may be required in addition to, or instead of, the mobile device entering within the defined distance from the lock.

The series of physical interactions can be displayed in an interaction settings field 608. The series can be edited by using buttons below the interaction settings field 608 (such as an insert short interaction button 610, an insert long interaction button 612, and a delete button 614). A save button 616 can cause settings displayed on the screen to be stored and used in device and/or service configurations. A navigation button 618 (such as a back button) can aid in moving between user interfaces (or screens of a user interface).

In some embodiments, physical interaction can be used as a backup when an authorized mobile device is lost or unavailable. For example, a user can set a series of three dots (e.g., short pushes), three dashes (e.g., three long pushes), and three dots, and click on the save button 616. When a mobile device is unavailable, the user can push on the shank of the lock using the series entered previously to open the lock (e.g., three clicks, three holds, and three clicks). This interaction can allow the lock to open.

In some embodiments, the lock can transition temporarily to credential-free operation when the series is correctly entered. A user can access settings (such as the user interface 600 in FIG. 6) or add devices within a time threshold after the lock is opened using the physical interaction method. In an embodiment, the series of physical interactions can be used to reset the lock to a default state. In some embodiments, a user can connect to the locking service to request authorization, successfully perform the series of physical interactions, and then receive access to the electronic lock (as the electronic lock can report the successful interaction to the locking service).

Figure 7:
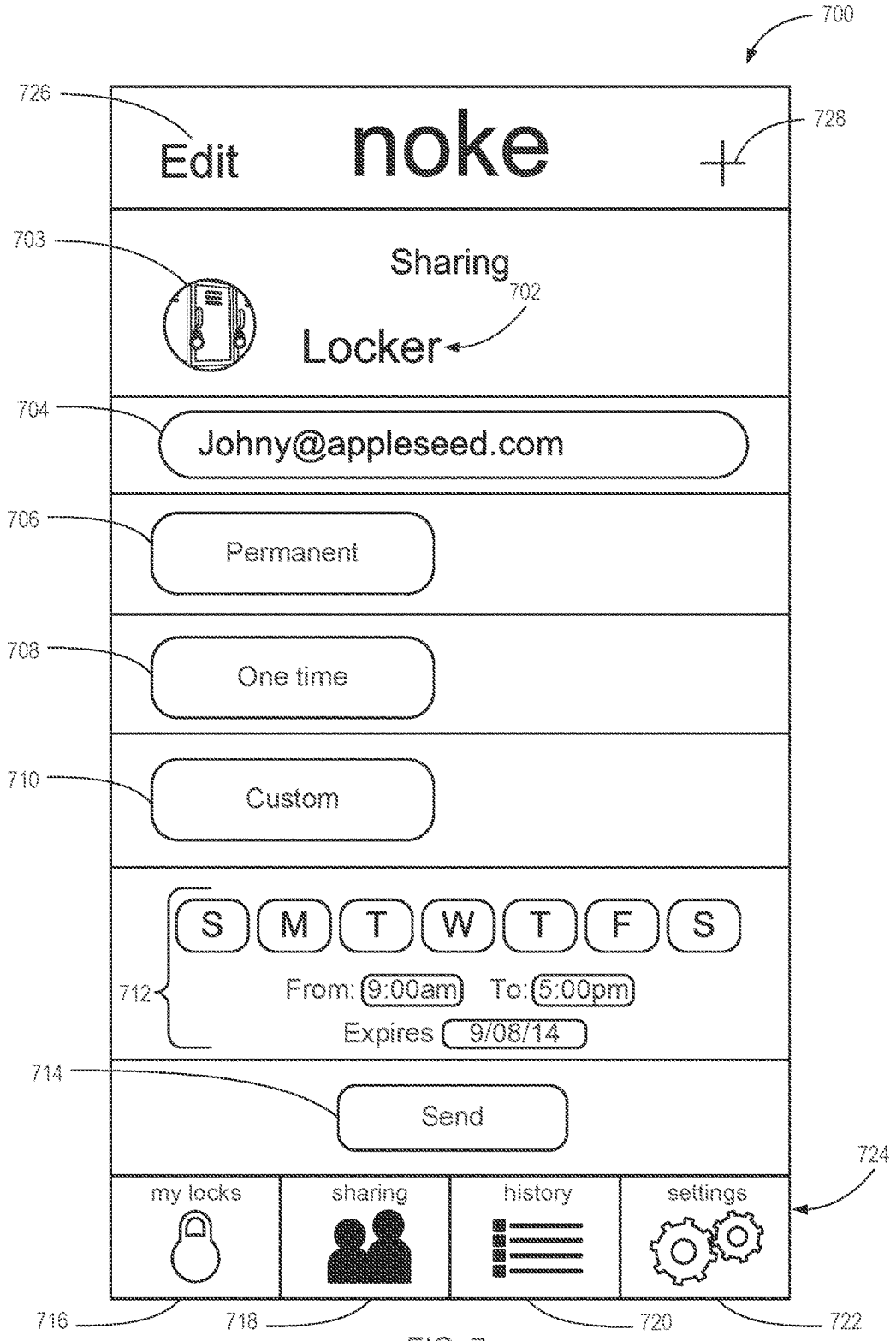
FIG. 7 is an illustration of a user interface for authorizing a user to unlock an electronic locking device, according to one embodiment.

FIG. 7 is an illustration of a user interface for authorizing a user to unlock an electronic locking device consistent with various embodiments disclosed herein. In an embodiment, the user can access a settings screen 700 that allows an administrative user to define permissions for an authorized user (and/or invite a new user to accept permissions to the lock). A lock can be identified in a title location 702 and a picture location 703. An authorized user can be identified by a user identifier 704 (such as an email, login, name, etc.). Permissions can be tailored to the user. Permissions can be set for permanent or single use, or further refined by days, times, and/or an expiration date. Permissions can be entered by clicking a permanent button 706, a one-time button 708, or a custom button 710. In the embodiment shown, the custom button 710 can be used to enable a date selection input area 712 in which days of weeks, times, and/or an expiration date can be entered. The interface may include additional options. For example, preprogrammed access levels (e.g., master, primary, secondary) and verification of authorization requirements (e.g., how often a mobile device must verify authorization with a server). Once the permissions have been entered, the user can activate the send button 714 to send an authorization or invitation to share access to the lock.

In some embodiments, the settings screen 700 can include an edit button 726 to enable editing of a current lock. In one embodiment, an add button or plus button 728 can be used to add an additional lock (e.g., pair a lock) to the application and/or mobile device. In some embodiments, this authorization is sent by email to a user, inviting the user to accept the permissions, download a mobile application, and/or create an account with the service.

Other user interface screens can include a list of locks, a history of interactions with the locks and/or service, lock settings, and/or application settings. These screens can be accessed by a menu row 724, including buttons 716, 718, 720, and 722.

Figure 8:
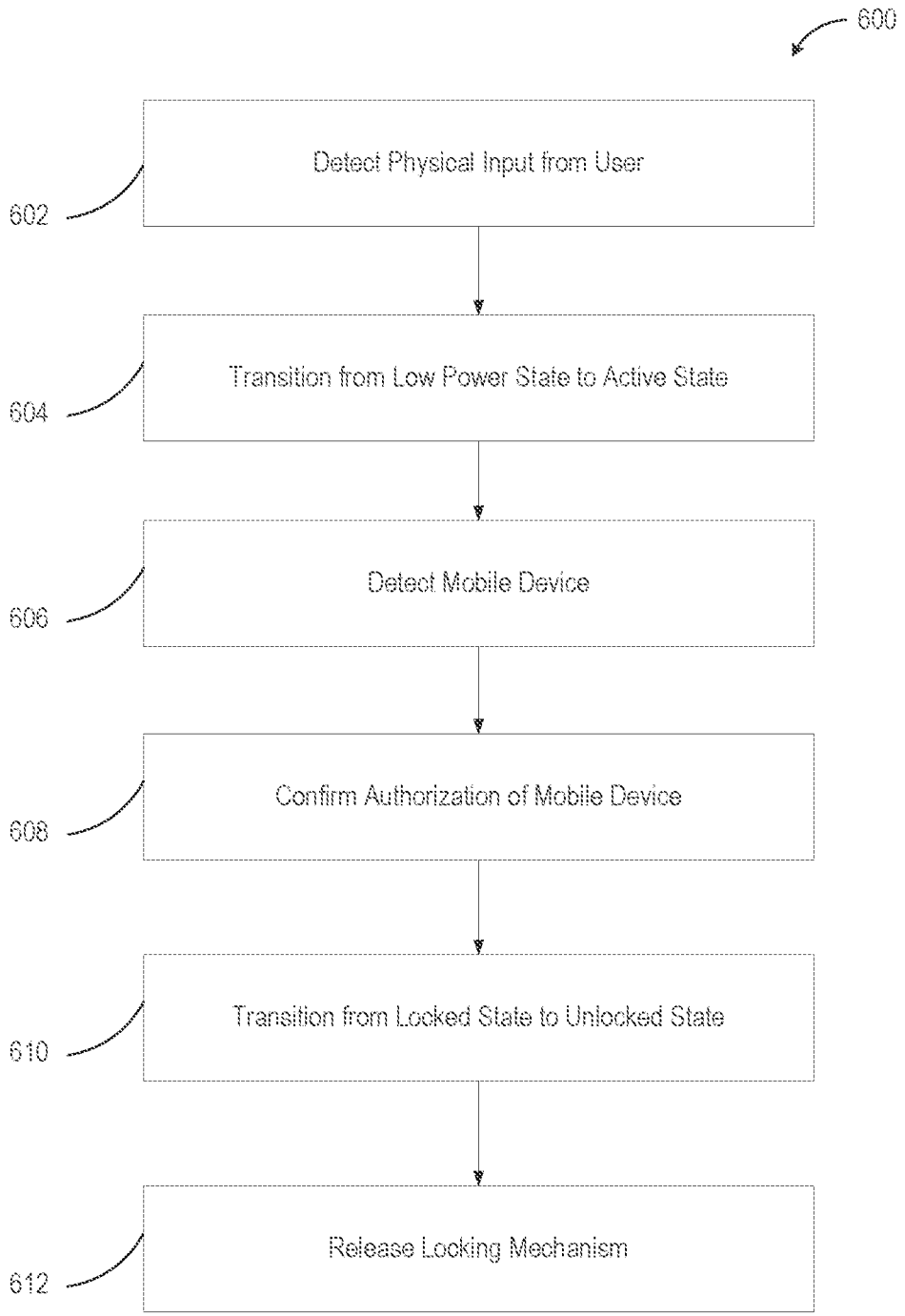
FIG. 8 is a flow chart illustrating a method for unlocking an electronic lock, according to one embodiment.

FIG. 8 is a flow chart illustrating a method 800 for unlocking an electronic lock consistent with various embodiments disclosed herein. The method 800 can be accomplished by the system 500 shown in FIG. 5, including the electronic lock 518, the mobile device 520, and the lock application service 516. In box 802, the lock detects physical input from a user. In box 804, the physical input causes the lock to transition from a low power state to an active state. In box 806, the lock can detect a mobile device (such as through a mobile device responding to a beacon transmitted over a wireless channel). In box 808, the lock can confirm authorization of the mobile device to perform an action on the lock (e.g., open request). The authorization can be based on direct communication with the mobile device or communication through an intermediary (such as a locking service). In box 810, upon successful confirmation of the authorization, the lock can transition from a locked state to an unlocked state. In box 812, the lock can release a locking mechanism.

In some embodiments the operation in boxes 806-808 can be performed by a locking service. For example, the mobile device can send a message to a locking service that identifies a wireless beacon received by the mobile device and credentials of a user of the device. The receipt of the beacon can prove the mobile device is within the physical proximity of the lock. The locking service can confirm the authorization of the user to access the lock and transmit a message to the lock to cause the lock to transition from a locked state to an unlocked state.

In some embodiments, the active state is still a lower power state than when operating a lock. Lock operation components (and/or other components, such as wireless components) can be selectively deactivated when not needed.

The lock can also work with active and passive devices. In some embodiments, the electronic lock can communicate with an active mobile device (such as a smartphone or active wireless fob) and receive credentials (such as a certificate, token, etc.) from the active mobile device. In other embodiments, the electronic lock can receive information (such as an identifier, rolling code, pseudorandom number, etc.) from a passive device (passive key fob, etc.). For example, the lock can detect a transmission from a key fob and determine information within the transmission indicates an authorized user of the lock. In one example, the lock can query the key fob. In another example, a user can push a button that wakes up the key fob to provide the transmission.

Figure 9:
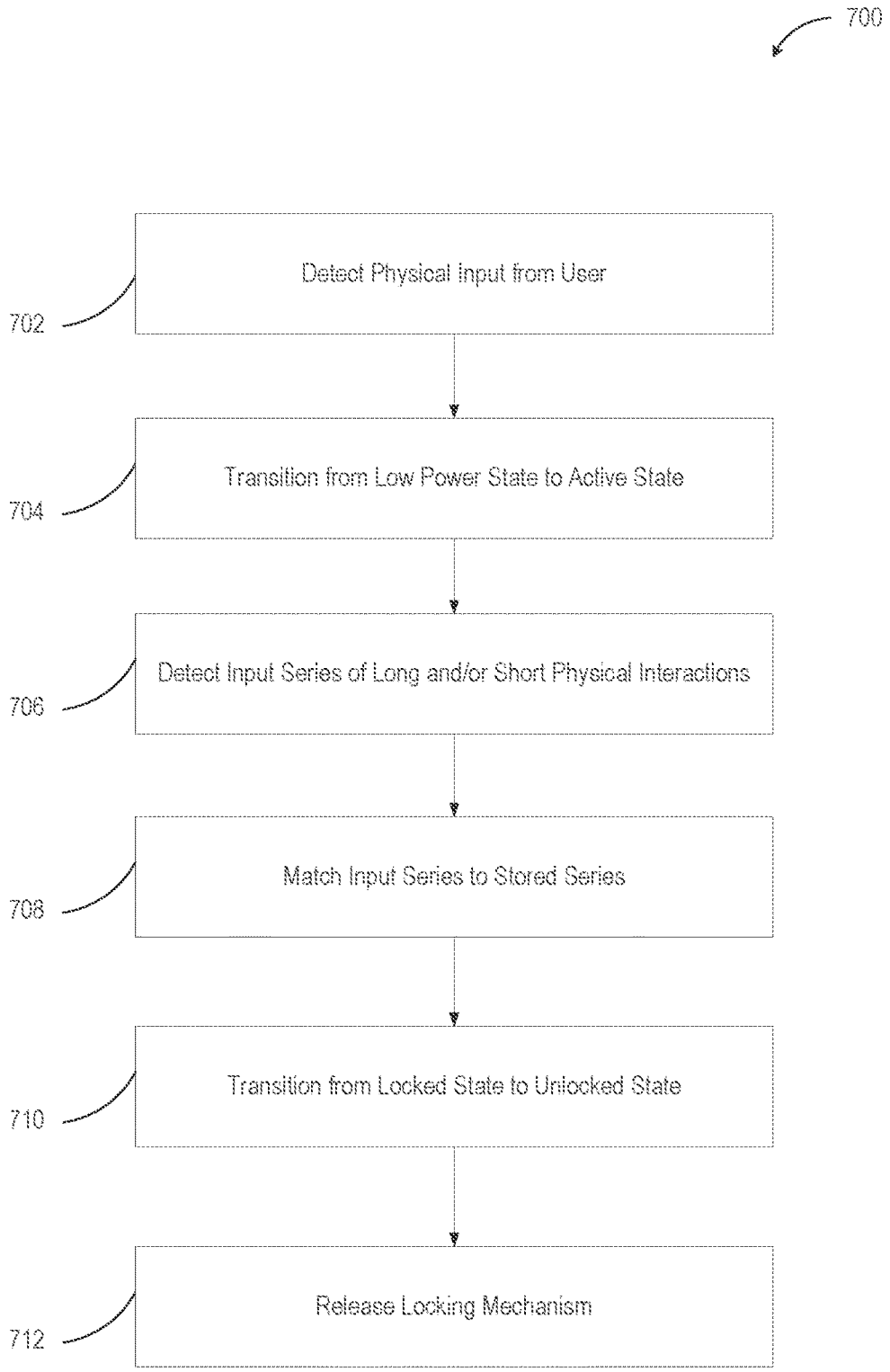
FIG. 9 is a flow chart illustrating an alternative method for unlocking an electronic lock, according to one embodiment.

FIG. 9 is a flow chart illustrating an alternative method 900 for unlocking an electronic lock consistent with various embodiments disclosed herein. The method 900 can be accomplished by the system 500 shown in FIG. 5, including the electronic lock 518, the mobile device 520, and the lock application service 516. In box 902, the lock can detect physical input from a user. In box 904 and in response to the physical input, the lock can transition from a low power state to an active state. In box 906, the lock can detect an input series of long and/or short physical interactions with the device (e.g., long clicks with short clicks, long touches with short touches, longer duration shakes and shorter duration shakes, etc.). In one embodiment, a long duration interaction can last half a second or longer and a short duration interaction can be for less than half a second. In another embodiment, a long duration interaction can last more than one second and a short duration interaction can be for one second or less. In box 908, the input series can be matched against a stored series that was configured prior to the input series. In box 910 and when the input series matches the stored series, the lock can transition from a locked state to an unlocked state. In box 912, the lock can release a locking mechanism allowing a physical unlocking of the lock from a captured object (e.g., hatch, latch, cable, etc.).

Depending on the embodiment, the lock can require a reset if a code is improperly entered. In one embodiment, unique physical interaction can be performed such as an extra-long duration interaction (such as twice the length or longer of a long duration interaction) or a secondary action (such as pressing of a button not used during entering of a code). For example, if a code is entered incorrectly by pressing on the shank, a user may touch a capacitive sensor on the front of the lock to reset an input status of the code on the lock. In another embodiment, the lock may reset if interaction is not detected for a period of time. In yet another embodiment, the lock examines the stream of inputs for a match. For example, if an incorrect input is performed, the user can simply restart entering the correct code. Once the stream matches a stored code, the lock can open.

It should be recognized that the electronic lock 518 can be operated with or without the lock application service 516. When operating without the lock application service 516, the lock or application on a mobile device can provide locking services (such as emailing authorization keys, peer-to-peer transfer of authorization keys, etc.). Verification of authorization can be performed onboard the lock by the processor.

Figure 10:
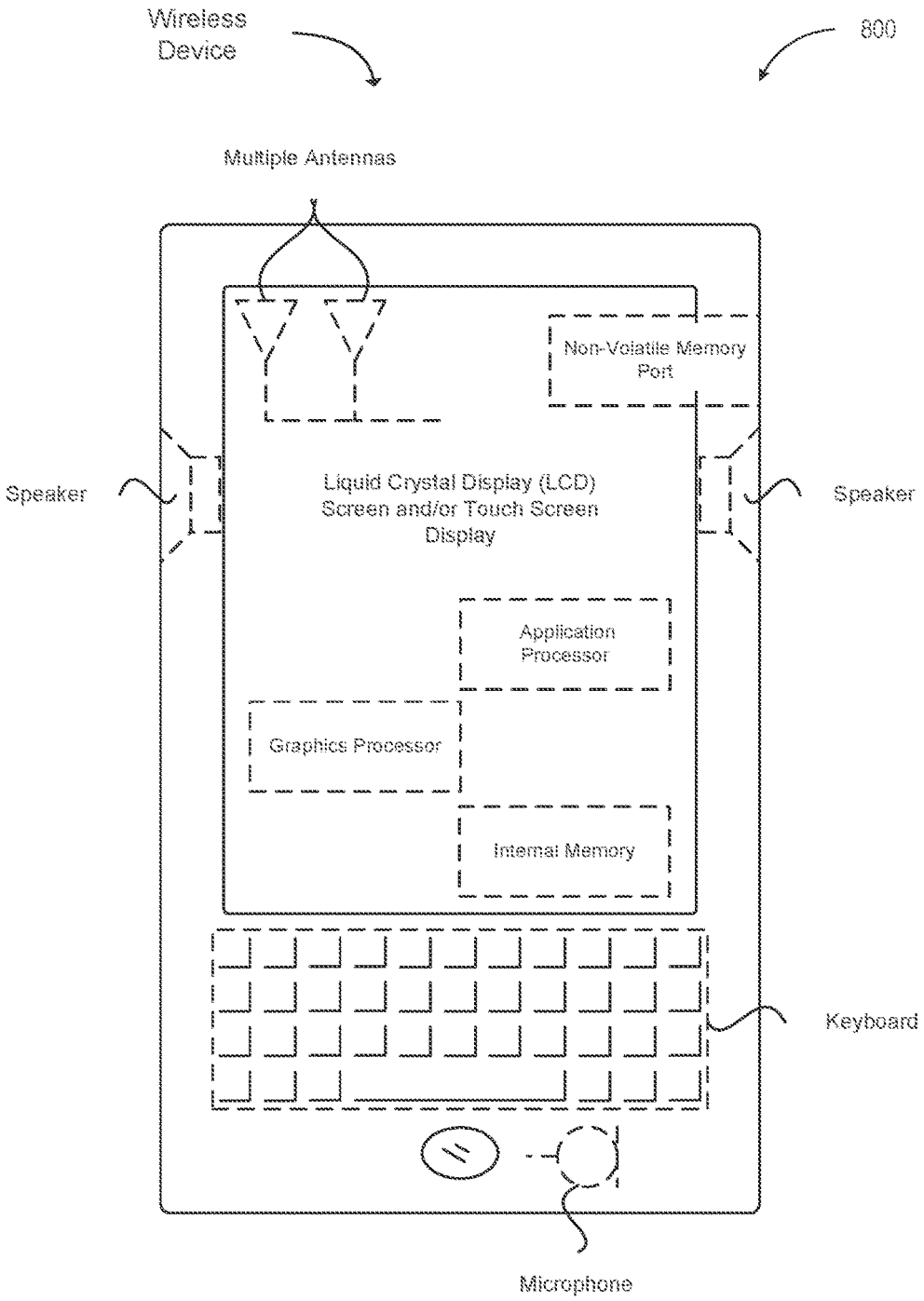
FIG. 10 is a diagram of a mobile device, according to one embodiment.

FIG. 10 is a diagram of a mobile device 1000 consistent with various embodiments disclosed herein. The mobile device 1000 can include multiple antennas, a speaker, a nonvolatile memory port, a keyboard (electronic or physical), a microphone, a display (such as an LCD screen), a touch screen, an application processor, a graphics processor, and internal memory. The mobile device 1000 can connect to one or more wireless services through wireless protocols such as LTE™ by the third generation partnership project (3GPP)™, WiFi™ as defined by IEEE 802.11 standards, Bluetooth™ by Bluetooth SIG, Inc. (including Bluetooth™ 4.0/Bluetooth™ Low Power), etc. The mobile device 1000 can process instructions on its application processor and graphics processor using internal memory and render one or more user interfaces (which can include one or more screens) to the display.

Figure 11:
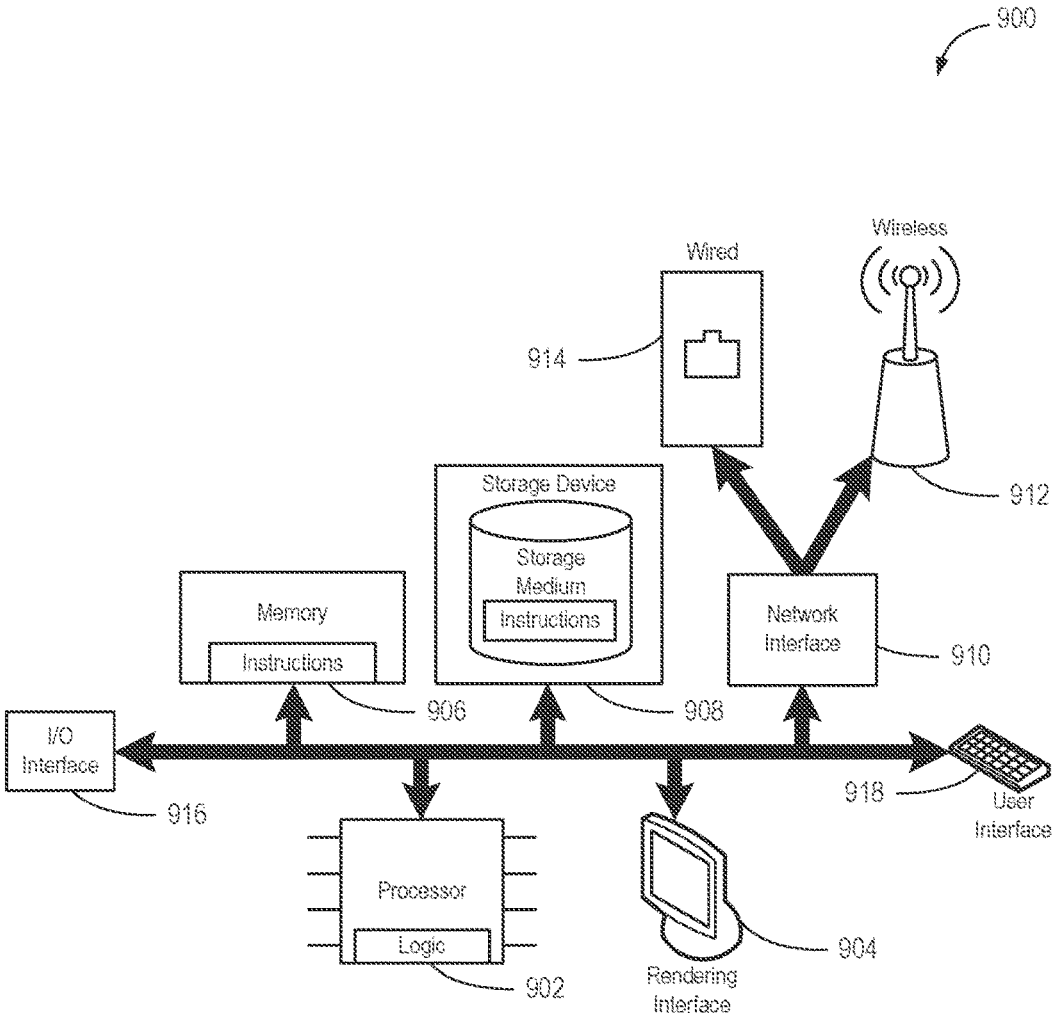
FIG. 11 is a schematic diagram of a computing system, according to one embodiment.

FIG. 11 is a schematic diagram of a computing system 1100 consistent with various embodiments disclosed herein. The computing system 1100 can be viewed as an information passing bus that connects various components. In the embodiment shown, the computing system 1100 includes a processor 1102 having logic for processing instructions. Instructions can be stored in and/or retrieved from memory 1106 and a storage device 1108 that includes a computer-readable storage medium. Instructions and/or data can arrive from a network interface 1110 that can include wired 1114 or wireless 1112 capabilities. Instructions and/or data can also come from an I/O interface 1116 that can include such things as expansion cards, secondary buses (e.g., USB, etc.), devices, etc. A user can interact with the computing system 1100 though a user interface device 1118 and a rendering interface 1104 that allows the computer to receive and provide feedback to the user.

Figure 12:
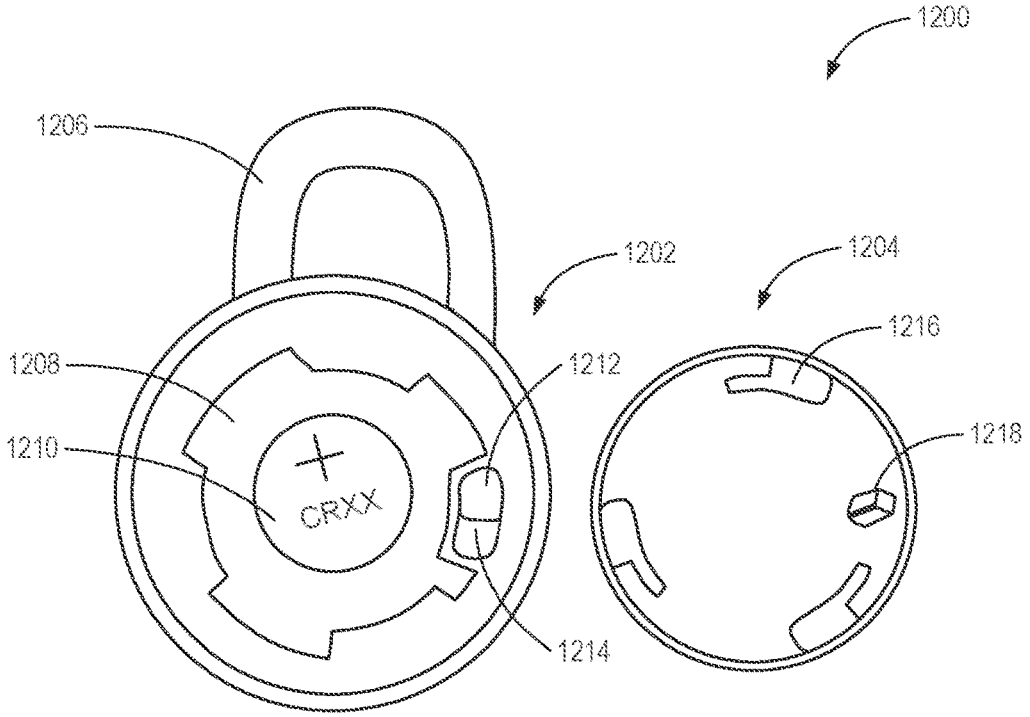
FIG. 12 is a back view of an electronic locking device showing a battery compartment.

FIG. 12 shows a back view of a battery compartment 1202 and battery compartment lid 1204 of an electronic lock 1200. In the embodiment show, the battery compartment 1202 and battery compartment lid 1204 are configured to remain locked together until the electronic lock is in an unlocked state (e.g., the shank 1206 is able to freely move).

In the embodiment shown, locking tabs 1216 slide under flanges of locking plate 1218 when twisted. Post 1218 slides into void 1214. Shank tip 1212 prevents movement of the post 1218, which prevents rotation of the battery compartment lid 1204 when in a locked state. When in an unlocked state, post 1218 can move within in void 1218, allowing the battery compartment lid 1204 to rotate and locking tabs 1216 to rotate from under flanges of locking plate 1218. When open, battery 1210 can be removed and/or replaced.

Embodiments and implementations of the systems and methods described herein may include various operations, which may be embodied in machine-executable instructions to be executed by a computer system. A computer system may include one or more general-purpose or special-purpose computers (or other electronic devices). The computer system may include hardware components that include specific logic for performing the operations or may include a combination of hardware, software, and/or firmware.

Computer systems and the computers in a computer system may be connected via a network. Suitable networks for configuration and/or use as described herein include one or more local area networks, wide area networks, metropolitan area networks, and/or Internet or IP networks, such as the World Wide Web, a private Internet, a secure Internet, a value-added network, a virtual private network, an extranet, an intranet, or even stand-alone machines that communicate with other machines by physical transport of media. In particular, a suitable network may be formed from parts or entireties of two or more other networks, including networks using disparate hardware and network communication technologies.

One suitable network includes a server and one or more clients; other suitable networks may contain other combinations of servers, clients, and/or peer-to-peer nodes, and a given computer system may function both as a client and as a server. Each network includes at least two computers or computer systems, such as the server and/or clients. A computer system may include a workstation, laptop computer, disconnectable mobile computer, server, mainframe, cluster, so-called "network computer" or "thin client," tablet, smartphone, personal digital assistant or other hand-held computing device, "smart" consumer electronics device or appliance, medical device, or a combination thereof.

Suitable networks may include communications or networking software, such as the software available from Novell®, Microsoft®, and other vendors, and may operate using TCP/IP, SPX, IPX, and other protocols over twisted pair, coaxial, or optical fiber cables; telephone lines; radio waves; satellites; microwave relays; modulated AC power lines; physical media transfer; and/or other data transmission "wires" known to those of skill in the art. The network may encompass smaller networks and/or be connectable to other networks through a gateway or similar mechanism.

Various techniques, or certain aspects or portions thereof, may take the form of program code (i.e., instructions) embodied in tangible media, such as floppy diskettes, CDROMs, hard drives, magnetic or optical cards, solid-state memory devices, a nontransitory computer-readable storage medium, or any other machine-readable storage medium wherein, when the program code is loaded into and executed by a machine, such as a computer, the machine becomes an apparatus for practicing the various techniques. In the case of program code execution on programmable computers, the computing device may include a processor, a storage medium readable by the processor (including volatile and nonvolatile memory and/or storage elements), at least one input device, and at least one output device. The volatile and nonvolatile memory and/or storage elements may be a RAM, an EPROM, a flash drive, an optical drive, a magnetic hard drive, or other medium for storing electronic data. One or more programs that may implement or utilize the various techniques described herein may use an application programming interface (API), reusable controls, and the like. Such programs may be implemented in a high-level procedural or an object-oriented programming language to communicate with a computer system. However, the program(s) may be implemented in assembly or machine language, if desired. In any case, the language may be a compiled or an interpreted language, and combined with hardware implementations.

Each computer system includes one or more processors and/or memory; computer systems may also include various input devices and/or output devices. The processor may include a general-purpose device, such as an Intel®, AMD®, or other "off-the-shelf" microprocessor. The processor may include a special-purpose processing device, such as ASIC, SoC, SiP, FPGA, PAL, PLA, FPLA, PLD, or other customized or programmable device. The memory may include static RAM, dynamic RAM, flash memory, one or more flip-flops, ROM, CD-ROM, DVD, disk, tape, or magnetic, optical, or other computer storage medium. The input device(s) may include a keyboard, mouse, touch screen, light pen, tablet, microphone, sensor, or other hardware with accompanying firmware and/or software. The output device(s) may include a monitor or other display, printer, speech or text synthesizer, switch, signal line, or other hardware with accompanying firmware and/or software.

It should be understood that many of the functional units described in this specification may be implemented as one or more components, which is a term used to more particularly emphasize their implementation independence. For example, a component may be implemented as a hardware circuit comprising custom very large scale integration (VLSI) circuits or gate arrays, or off-the-shelf semiconductors such as logic chips, transistors, or other discrete components. A component may also be implemented in programmable hardware devices such as field programmable gate arrays, programmable array logic, programmable logic devices, or the like.

Components may also be implemented in software for execution by various types of processors. An identified component of executable code may, for instance, comprise one or more physical or logical blocks of computer instructions, which may, for instance, be organized as an object, a procedure, or a function. Nevertheless, the executables of an identified component need not be physically located together, but may comprise disparate instructions stored in different locations that, when joined logically together, comprise the component and achieve the stated purpose for the component.

Indeed, a component of executable code may be a single instruction, or many instructions, and may even be distributed over several different code segments, among different programs, and across several memory devices. Similarly, operational data may be identified and illustrated herein within components, and may be embodied in any suitable form and organized within any suitable type of data structure. The operational data may be collected as a single data set, or may be distributed over different locations including over different storage devices, and may exist, at least partially, merely as electronic signals on a system or network. The components may be passive or active, including agents operable to perform desired functions.

Several aspects of the embodiments described will be illustrated as software modules or components. As used herein, a software module or component may include any type of computer instruction or computer-executable code located within a memory device. A software module may, for instance, include one or more physical or logical blocks of computer instructions, which may be organized as a routine, a program, an object, a component, a data structure, etc., that perform one or more tasks or implement particular data types. It is appreciated that a software module may be implemented in hardware and/or firmware instead of or in addition to software. One or more of the functional modules described herein may be separated into sub-modules and/or combined into a single or smaller number of modules.

In certain embodiments, a particular software module may include disparate instructions stored in different locations of a memory device, different memory devices, or different computers, which together implement the described functionality of the module. Indeed, a module may include a single instruction or many instructions, and may be distributed over several different code segments, among different programs, and across several memory devices. Some embodiments may be practiced in a distributed computing environment where tasks are performed by a remote processing device linked through a communications network. In a distributed computing environment, software modules may be located in local and/or remote memory storage devices. In addition, data being tied or rendered together in a database record may be resident in the same memory device, or across several memory devices, and may be linked together in fields of a record in a database across a network.

Reference throughout this specification to "an example" means that a particular feature, structure, or characteristic described in connection with the example is included in at least one embodiment of the present invention. Thus, appearances of the phrase "in an example" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on its presentation in a common group without indications to the contrary. In addition, various embodiments and examples of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of materials, frequencies, sizes, lengths, widths, shapes, etc., to provide a thorough understanding of embodiments of the invention. One skilled in the relevant art will recognize, however, that the invention may be practiced without one or more of the specific details, or with other methods, components, materials, etc. In other instances, well-known structures, materials, or operations are not shown or described in detail to avoid obscuring aspects of the invention.

Although the foregoing has been described in some detail for purposes of clarity, it will be apparent that certain changes and modifications may be made without departing from the principles thereof. It should be noted that there are many alternative ways of implementing both the processes and apparatuses described herein. Accordingly, the present embodiments are to be considered illustrative and not restrictive, and the invention is not to be limited to the details given herein, but may be modified within the scope and equivalents of the appended claims.

Those having skill in the art will appreciate that many changes may be made to the details of the above-described embodiments without departing from the underlying principles of the invention. The scope of the present invention should, therefore, be determined only by the following claims.

The invention claimed is:

1. A method for unlocking an electronic lock, comprising:

detecting, via a manually actuatable sensor associated with an electronic lock, durations of each of a series of manual input interactions while a locking mechanism of the electronic lock is in a locked state, wherein the series of input interactions comprises an ordered plurality of distinct input interactions of varying durations based on the movement of a first portion of the electronic locking system with respect to a second portion of the electronic locking system;

comparing the detected series of manual input interactions of varying durations with a stored series of ordered manual input interactions of at least two different durations; and instructing the locking mechanism to transition to an unlocked state based on a determination that the detected ordered series of durations of manual input interactions of movements of the first portion of the electronic system matches the stored series of ordered manual input interactions of varying durations.

2. The method of claim 1, wherein comparing the detected series of manual input interactions with the stored series of manual input interactions is performed by a remote processing device.

3. The method of claim 2, wherein the remote processing device, the sensor, and the locking mechanism are each an independent component, and wherein the sensor is in communication with the remote processing device and the remote processing device is in communication with the locking mechanism.

4. The method of claim 1, wherein the sensor is integral with the electronic lock.

5. The method of claim 1, wherein the sensor is directly connected to a processing unit, and wherein a processing unit within the electronic lock performs the steps of comparing and instructing.

6. The method of claim 1, wherein detecting the series of input interactions via the sensor comprises detecting a series of triggers of a light sensor of varying durations.

7. The method of claim 1, wherein instructing the locking mechanism to transition to an unlocked state is further based on a determination that a second sensor has been activated.

8. An electronic locking system, comprising:

a locking mechanism to transition between a locked state and an unlocked state;

a manually actuatable sensor associated with the locking mechanism to detect manual input interactions of varying durations by an operator that include moving one portion of the electronic locking system with respect to another portion of the electronic locking system;

a digital storage medium associated with the locking mechanism to store an unlock code as an ordered plurality of distinct input interactions of at least two different durations; and a controller to perform operations to:

detect a series of manual input interactions of varying durations via the manually actuatable sensor that each include movement of one portion of the electronic locking system with respect to another portion of the electronic locking system;

compare durations of the detected series of manual input interactions with the stored unlock code defined by the ordered series of input interactions and corresponding input durations; and transition the locking mechanism from the locked state to the unlocked state when the detected series of manual input interactions of varying durations matches the stored unlock code defined by the ordered series of input interactions and corresponding input durations.

9. The electronic lock of claim 8, wherein the stored ordered series of input interactions comprises an ordered plurality of distinct input interactions that additionally vary in intensity.

10. The electronic lock of claim 8, wherein the electronic lock comprises a U-lock.

11. The electronic lock of claim 8, wherein the electronic lock comprises a door lock.

12. The electronic lock of claim 8, further comprising a power supply module configured to remain in a low power state until a first input interaction is detected via the sensor.

13. The electronic lock of claim 8, wherein the sensor comprises an accelerometer.

14. The electronic lock of claim 8, wherein the sensor comprises one of a button and a switch.

15. The electronic lock of claim 8, wherein the sensor comprises a touch sensor.

* * * * *